US012622500B2

(12) United States Patent
Lee et al.

(10) Patent No.: US 12,622,500 B2
(45) Date of Patent: May 12, 2026

(54) COSMETIC VESSEL

(71) Applicant: LG H&H Co., LTD., Seoul (KR)

(72) Inventors: In Sun Lee, Seoul (KR); Kyung Won Kim, Seoul (KR); Hoon Ki Kim, Seoul (KR); Eun Mi Kim, Seoul (KR); Jin Young We, Seoul (KR)

(73) Assignee: LG H&H CO., LTD., Seoul (KR)

( * ) Notice: Subject to any disclaimer, the term of this patent is extended or adjusted under 35 U.S.C. 154(b) by 154 days.

(21) Appl. No.: 18/423,040

(22) Filed: Jan. 25, 2024

(65) Prior Publication Data

US 2024/0349869 A1 Oct. 24, 2024

(30) Foreign Application Priority Data

Apr. 20, 2023 (KR) ..... 10-2023-0051690
Jul. 11, 2023 (KR) ..... 10-2023-0089920

(51) Int. Cl.
*A45D 34/04* (2006.01)
*A45D 40/00* (2006.01)
*A45D 40/26* (2006.01)

(52) U.S. Cl.
CPC ..... *A45D 34/04* (2013.01); *A45D 40/26* (2013.01); *A45D 2040/0018* (2013.01); *A45D 2200/05* (2013.01); *A45D 2200/20* (2013.01)

(58) Field of Classification Search
CPC ..... A45D 40/26; A45D 2020/20; A45D 2200/05; A45D 2040/0018; A45D 34/04
See application file for complete search history.

(56) References Cited

U.S. PATENT DOCUMENTS

| | | | |
|---|---|---|---|
| 4,139,127 | A | 2/1979 | Gentile |
| 4,664,547 | A | 5/1987 | Rosenwinkel |
| 4,702,399 | A | 10/1987 | Davis |
| 4,950,094 | A | 8/1990 | Yorks |
| 4,984,718 | A | 1/1991 | Cardia |
| 5,437,513 | A | 8/1995 | Favre |
| 5,445,465 | A | 8/1995 | Cardia |
| 5,961,007 | A | 10/1999 | Dornbusch et al. |
| 6,231,259 | B1 | 5/2001 | Murgida et al. |
| 6,357,945 | B1 | 3/2002 | Losier et al. |
| 6,398,439 | B1 | 6/2002 | Szekely |

(Continued)

FOREIGN PATENT DOCUMENTS

| | | | |
|---|---|---|---|
| CN | 100360065 | C | 1/2008 |
| CN | 101854828 | A | 10/2010 |

(Continued)

OTHER PUBLICATIONS

Machine translation of JP-2016537051-A.*

*Primary Examiner* — Jeremy Carroll
(74) *Attorney, Agent, or Firm* — Birch, Stewart, Kolasch & Birch, LLP

(57) ABSTRACT

The present invention includes a vessel portion for accommodating contents in a vessel body; a lower cover portion sealing the vessel body; a pressurizing portion pressurizing an interior of the vessel body to discharge the contents; and an auxiliary portion elevating and lowering the pressurizing portion, wherein in the pressurizing portion, an upward movement and a downward movement may occur alternately and repeatedly while the pressurizing portion pressurizes an interior of the vessel body to discharge the contents.

23 Claims, 17 Drawing Sheets

(56) References Cited

U.S. PATENT DOCUMENTS

| | | | | |
|---|---|---|---|---|
| 6,550,999 | B2 | 4/2003 | Petit et al. | |
| 6,648,538 | B2 | 11/2003 | Gueret | |
| 6,996,908 | B2 | 2/2006 | Orloff et al. | |
| 7,210,870 | B2 | 5/2007 | Breidenbac et al. | |
| 7,789,582 | B2 | 9/2010 | Babel et al. | |
| 8,875,955 | B2 | 11/2014 | Arora et al. | |
| 9,210,985 | B2 | 12/2015 | Arwatz et al. | |
| 9,265,327 | B2 | 2/2016 | Thulin et al. | |
| 9,826,813 | B2 * | 11/2017 | Lee | B05B 11/028 |
| 9,908,140 | B2 | 3/2018 | Arwatz et al. | |
| 11,246,393 | B2 | 2/2022 | Brugger et al. | |
| 11,325,766 | B2 | 5/2022 | Chen | |
| 2003/0014866 | A1 | 1/2003 | Orloff et al. | |
| 2009/0324317 | A1 | 12/2009 | Batchelor et al. | |
| 2010/0104345 | A1 | 4/2010 | Nasu et al. | |
| 2010/0217176 | A1 * | 8/2010 | Carrara | A45D 34/04 604/311 |
| 2012/0207531 | A1 | 8/2012 | Rusev | |
| 2012/0321368 | A1 * | 12/2012 | Lim | A45D 34/04 401/118 |
| 2013/0287468 | A1 | 10/2013 | Roppa | |
| 2015/0003885 | A1 | 1/2015 | Wade et al. | |
| 2017/0333688 | A1 | 11/2017 | Parikh et al. | |
| 2022/0061498 | A1 | 3/2022 | Abergas et al. | |

FOREIGN PATENT DOCUMENTS

| | | | | |
|---|---|---|---|---|
| CN | 101472500 | B | 4/2011 | |
| CN | 101674749 | B | 4/2012 | |
| CN | 102630146 | A | 8/2012 | |
| CN | 105919268 | A | 9/2016 | |
| CN | 205671735 | U | 11/2016 | |
| CN | 205696343 | U | 11/2016 | |
| CN | 210503852 | U | 5/2020 | |
| CN | 211431434 | U | 9/2020 | |
| CN | 211794838 | U | 10/2020 | |
| CN | 214483635 | U | 10/2021 | |
| CN | 216568831 | U | 5/2022 | |
| CN | 110799059 | B | 7/2022 | |
| JP | 3642536 | B2 | 4/2005 | |
| JP | 4931000 | B2 | 5/2012 | |
| JP | 4941972 | B2 | 5/2012 | |
| JP | 2016-522065 | A | 7/2016 | |
| JP | 2016537051 | A * | 12/2016 | B05B 11/1052 |
| JP | 6285548 | B2 | 2/2018 | |
| KR | 20-0230134 | Y1 | 7/2001 | |
| KR | 10-2004-0034228 | A | 4/2004 | |
| KR | 20-0361671 | Y1 | 9/2004 | |
| KR | 20-0452889 | Y1 | 3/2011 | |
| KR | 10-1049783 | B1 | 7/2011 | |
| KR | 10-2012-0016493 | A | 2/2012 | |
| KR | 10-1192716 | B1 | 10/2012 | |
| KR | 20-2013-0000760 | U | 1/2013 | |
| KR | 20-2013-0001280 | U | 2/2013 | |
| KR | 10-2013-0143465 | A | 12/2013 | |
| KR | 10-1488504 | B1 | 2/2015 | |
| KR | 10-2015-0041960 | A | 4/2015 | |
| KR | 10-1508846 | B1 | 4/2015 | |
| KR | 10-2018-0081919 | A | 7/2018 | |
| KR | 10-2019-0044708 | A | 5/2019 | |

* cited by examiner

COSMETIC VESSEL

CROSS-REFERENCE TO RELATED PATENT APPLICATION

The present application claims priority under 35 U.S.C. § 119 (a) to Korean patent application number 10-2023-0051690 filed on Apr. 20, 2023 and Korean patent application number 10-2023-0089920 filed on Jul. 11, 2023, in the Korean Intellectual Property Office, the entire disclosure of which is incorporated by reference herein.

BACKGROUND OF THE INVENTION

1. Field

The present invention relates to a cosmetic vessel, and more specifically, to a cosmetic vessel including a structure capable of minimizing residual pressure when discharging the contents by increasing the pressure inside the vessel by rotating a dial.

2. Description of the Related Art

People generally have a desire to make themselves beautiful through makeup. Therefore, people feel satisfied by making up their skin as well as lips, nails, hair, and others in various ways.

In the case of lips, makeup that makes the lips stand out from the face or dissolves dead skin cells in the lips and makes the lips smooth and plump is widely used. At this time, people use lip masks, lipstick, lip gloss, lip balm, lip tint, or the like to make up the lips. At this time, lip masks or the like not only make the lips look beautiful, but also prevent them from drying out and cracking, and have an effect of making the lips smooth and plump. Lip masks may be used on the lips depending on the type of vessel used, but depending on the type of formulation, they may be gripped by a body portion and then directly applied or may be applied by using the hands or other tools.

Lip masks are produced in various shapes, including tubes. Recently, when the lip mask is in the form of a tube, a dial is rotated to increase the pressure inside the vessel and discharge the cosmetics accommodated therein.

However, in the case of existing lip masks in the shape of tubes, when the cosmetics have high viscosity or hardness, there is an inconvenience in use that even after turning the dial, some of the cosmetics come out due to the residual pressure.

SUMMARY OF THE INVENTION

The present invention was created to solve the problem of the prior arts described above. The purpose of the present disclosure is to provide a cosmetic vessel that is capable of minimizing the internal residual pressure of a vessel body when discharging the contents by increasing the internal pressure of the vessel body by rotating a dial.

A cosmetic vessel according to one aspect of the present invention includes: a vessel portion for accommodating contents in a vessel body of which upper portion is sealed by an upper cover portion and which is provided with a discharge port at an upper portion; a lower cover portion sealing an open lower portion of the vessel body; a pressurizing portion pressurizing an interior of the vessel body to discharge the contents; and an auxiliary portion elevating and lowering the pressurizing portion by rotation, wherein in the pressurizing portion, an upward movement and a downward movement may occur alternately and repeatedly while the pressurizing portion pressurizes an interior of the vessel body by being elevated by the auxiliary portion to discharge the contents.

Specifically, the pressurizing portion may increase the internal pressure of the vessel body by an upward movement to discharge the contents and may dissipate a residual pressure remaining in the vessel body through an downward movement.

Specifically, the pressurizing portion may include a head portion that is elevated and lowered in close contact with an inner circumferential surface of the vessel body; and a pressurizing structure portion that is coupled to the auxiliary portion at a lower portion of the head portion and that causes the head portion to repeatedly undergo an upward movement and a downward movement alternately while the head portion is elevated and lowered.

Specifically, the head portion may be provided with a plurality of second guide protrusions on an outer circumferential surface, and the pressurizing structure portion may include: a first annular member being connected to the head portion, having a diameter smaller than the diameter of the head portion, and having a lower surface forming a first wave shape; a second first annular member being connected to the first annular member and having a diameter smaller than the diameter of the first annular member; and a third annular member being connected to the second annular member, having a diameter equal to the diameter of the first annular member, and having an upper surface forming a second wave shape, wherein the pressurizing structure portion forms a pressurizing guideline causing the head portion to undergo an upward movement and a downward movement alternately and repeatedly while the head portion is elevated and lowered by the first annular member, the second first annular member, and the third annular member.

Specifically, each of the first wave shape and the second wave shape may be a sine wave shape of a same period with repeated trough portions and crest portions, and the distance from the trough portion and the crest portion may be equal to the distance from the crest portion to another trough portion or longer than the distance from the crest portion to the other trough portion or shorter than the distance from the crest portion to the other trough portion.

Specifically, the auxiliary portion may include a plurality of pressurizing protrusions inserted into the pressurizing guideline, wherein the plurality of pressurizing protrusions, while rotating and rising in a state of being inserted into the pressurizing guideline and moving from the crest portion to the trough portion of the first wave shape, may cause the head portion to undergo an upward movement, and thereby increase the internal pressure of the vessel body so that the contents are discharged through the discharge port, and wherein the plurality of pressurizing protrusions, while rotating and rising in a state of being inserted into the pressurizing guideline and moving from the trough portion to the crest portion of the first wave shape, may cause the head portion to undergo a downward movement, and thereby decrease the internal pressure of the vessel body so that the contents are not discharged by a residual pressure.

Specifically, the pressurizing portion may increase the amount of the downward momentum of the head portion as the height difference value between the crest portion and the trough portion of the first wave shape increases, thereby increasing the dissipated amount of the internal residual pressure, wherein the height difference value may be any one of 0.25 mm, 0.35 mm, and 0.45 mm.

Specifically, when the plurality of pressurizing protrusions rotate and rise in a state of being inserted into the pressurizing guideline and undergo a rotational operation in one cycle from the crest portion of the first wave shape to another neighboring crest portion, the pressurizing portion may cause the contents to be discharged once.

Specifically, the pressurizing portion may shorten the period of one cycle, as the distance value or angle value (based on a circle) between the trough portion of the first wave shape and the other trough portion or between the crest portion and the other crest portion is decreased, thereby increasing the number of times of discharge of the contents and decreasing the amount of discharge of the contents based on a rotation of 360 degrees, and wherein the angle value may be any one of 9 degrees, 18 degrees, 22.5 degrees, 45 degrees, and 90 degrees based on one cycle.

Specifically, a surface on which the discharge port is provided may have any one shape of convex, concave, and flat shapes, and may be formed of at least one of metal, aluminum, zinc alloy, ceramic, and plastic, wherein the discharge port may be formed in any one shape of a circular shape and a wavy shape.

Specifically, the cosmetic vessel may further include: a middle portion providing a rotational force to the auxiliary portion; a fixed plate fixed to the lower cover portion; and a shaft portion provided with a male threaded pillar supported by the fixed plate and extending to an upper portion of the vessel body.

Specifically, the lower cover portion may provide a rotational force to the auxiliary portion, and the lower cover portion and the middle portion may directly provide a rotational force to the auxiliary portion or may indirectly provide a rotational force to the auxiliary portion through the vessel body.

Specifically, the vessel portion may include: a plurality of coupling protrusions provided on a part of an upper outer circumferential surface of the vessel body; and a plurality of guide grooves extending from a lower portion to an upper portion in a groove shape in a constant interval on an inner circumferential surface of the vessel body, wherein the middle portion may include a rotatable intermediate body provided in the form of a shell on an upper outer circumferential surface of the vessel body; and a plurality of coupling grooves coupled to the plurality of coupling protrusions on a part of an upper inner circumferential surface, wherein the auxiliary portion may include a support plate on which a female threaded member screwed to the male threaded pillar of the shaft portion is provided at the center; and a plurality of first guide protrusions provided on an outer circumferential surface of the support plate and inserted into the plurality of guide grooves of the vessel body.

Specifically, the vessel body may rotate together when the middle portion rotates, thereby transmitting a rotational force of the middle portion to the auxiliary portion, wherein the shaft portion may rotate together when the lower cover portion rotates, thereby transmitting a rotational force of the lower cover portion to the auxiliary portion, wherein the auxiliary portion may receive a rotational force from the vessel body or the shaft portion and rotate to elevate and lower the pressurizing portion along the male threaded pillar.

Specifically, the auxiliary portion may consist of a first auxiliary portion and a second auxiliary portion provided between the shaft portion and the pressurizing portion, wherein the first auxiliary portion may include: the support plate seated on the fixed plate of the shaft portion; the plurality of first guide protrusions provided on an outer circumferential surface of the support plate and inserted into the plurality of guide grooves of the vessel body; and the female threaded member provided at the center of the support plate and screwed to the male threaded pillar of the shaft portion, wherein the second auxiliary portion may include a rim accommodating the pressurizing structure portion and having a plurality of cut grooves formed in a constant interval to have elasticity; a plurality of pressurizing protrusions provided on an inner surface of the rim and inserted into the pressurizing guideline; a coupling pillar protruding upward from the center of the rim to be inserted into a coupling hole of the pressurizing structure portion and provided with a first insertion hole penetrating upward and downward to cause the male threaded pillar of the shaft portion to be inserted; and a fixing protrusion provided on an inner lower portion of the rim and fixed to a fixing groove of the pressurizing structure portion.

Specifically, the shaft portion may include a plurality of inserting grooves provided in a constant interval on an outer circumferential surface of the fixing plate, wherein the plurality of inserting grooves may be coupled to a plurality of fixing bars provided inside the lower cover portion.

Specifically, the vessel body may include a plurality of sound bars provided along an edge of an open lower portion and having elasticity, wherein the lower cover portion may include a plurality of sound protrusions continuously provided along an inner surface and may generate a sound by friction of the plurality of sound bars with the plurality of sound protrusions when the vessel body is rotated by the rotation of the middle portion.

Specifically, the vessel portion may be fastened to the upper cover portion by a fastening means, wherein the fastening means may include: a fastening groove provided along an inner circumferential surface of the upper cover portion; and a fastening protrusion provided continuously or discontinuously along an outer circumferential surface of the vessel body and fastened to the fastening groove in a snap-on fastening manner without horizontal restraining, and wherein, when the lower cover portion rotates in a state where the upper cover portion is fastened to the vessel portion, the fastening means may cause the lower cover portion to rotate idle with respect to the upper cover portion so that a rotational force of the lower cover portion is not transferred to the shaft portion, thereby preventing the contents from being discharged.

Specifically, in the cosmetic vessel, each time the pressurizing portion undergoes one cycle of rotational operation from a crest portion of the first wave shape provided in the first annular member through a trough portion to another crest portion, any one of the plurality of sound protrusions may undergo friction with the sound bar once, and in the process where the pressurizing portion undergoes one cycle of rotational operation, the contents may be discharged once while moving from the crest portion to the trough portion (upward movement of the pressurizing portion) but may not be discharged while moving from the trough portion to the other crest portion (downward movement of the pressurizing portion).

Specifically, the plurality of sound protrusions may be arranged in a constant interval on an inner circumferential surface of the lower cover portion in a number corresponding to a value obtained by dividing the sum of the number of times of upward movement of the pressurizing portion and the number of times of downward movement by 2.

Specifically, the angle value of one cycle of the pressurizing portion may correspond to a value obtained by dividing 360 degrees by a multiple of 4, and in the plurality of sound protrusions, the angle value of one cycle of the pressurizing portion may be an arrangement angle value at which the plurality of sound protrusions are arranged in a constant interval on an inner circumferential surface of the lower cover portion.

Specifically, each of the plurality of sound protrusions is arranged to correspond to the trough portion of the first wave shape, which is a point where discharge of the contents is completed once, so that the number of times of discharge of the contents is confirmed.

A cosmetic product according to another aspect of the present invention may include the cosmetic vessel described above and cosmetic contents accommodated in the cosmetic vessel.

The cosmetic vessel according to the present invention configures a pressurizing portion such that upward and downward movements may occur alternately and repeatedly while pressurizing an interior of the vessel body, so that the pressurizing portion increases the internal pressure of the vessel body by an upward movement to discharge the contents and dissipates the residual pressure remaining in the vessel body by a downward movement to prevent the phenomenon that some contents are leaked to the outside due to the residual pressure, thereby relieving the user's inconvenience and improving satisfaction.

DETAILED DESCRIPTION

Figure 1:
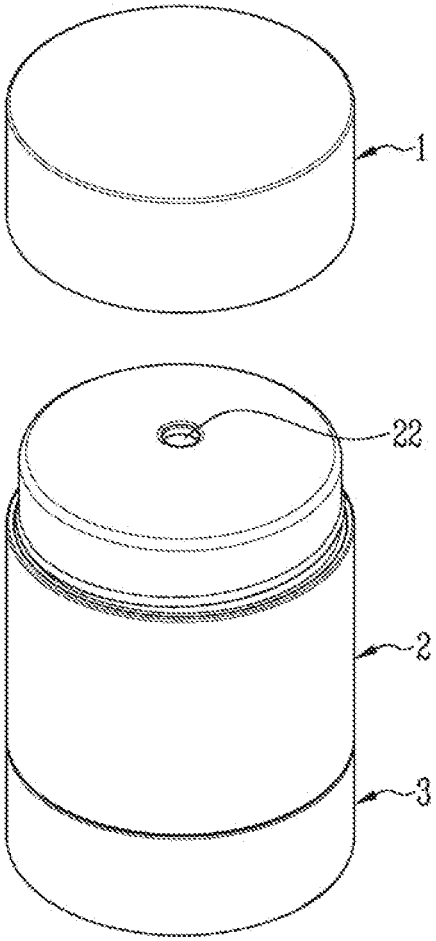
FIG. 1 is a perspective diagram of a cosmetic vessel according to one embodiment of the present invention.

The objects, specific advantages and novel features of the present invention will become more apparent from the following detailed description and preferred embodiments taken in conjunction with the accompanying drawings. In the present specification, when adding reference numerals to components in each drawing, it should be noted that identical components are given the same numerals as much as possible even if they are shown in different drawings. Additionally, in describing the present invention, when it is determined that a detailed description of related known technologies may unnecessarily obscure the gist of the present invention, the detailed description will be omitted.

Hereinafter, preferred embodiments of the present invention will be described in detail with reference to the attached drawings.

Figure 2:
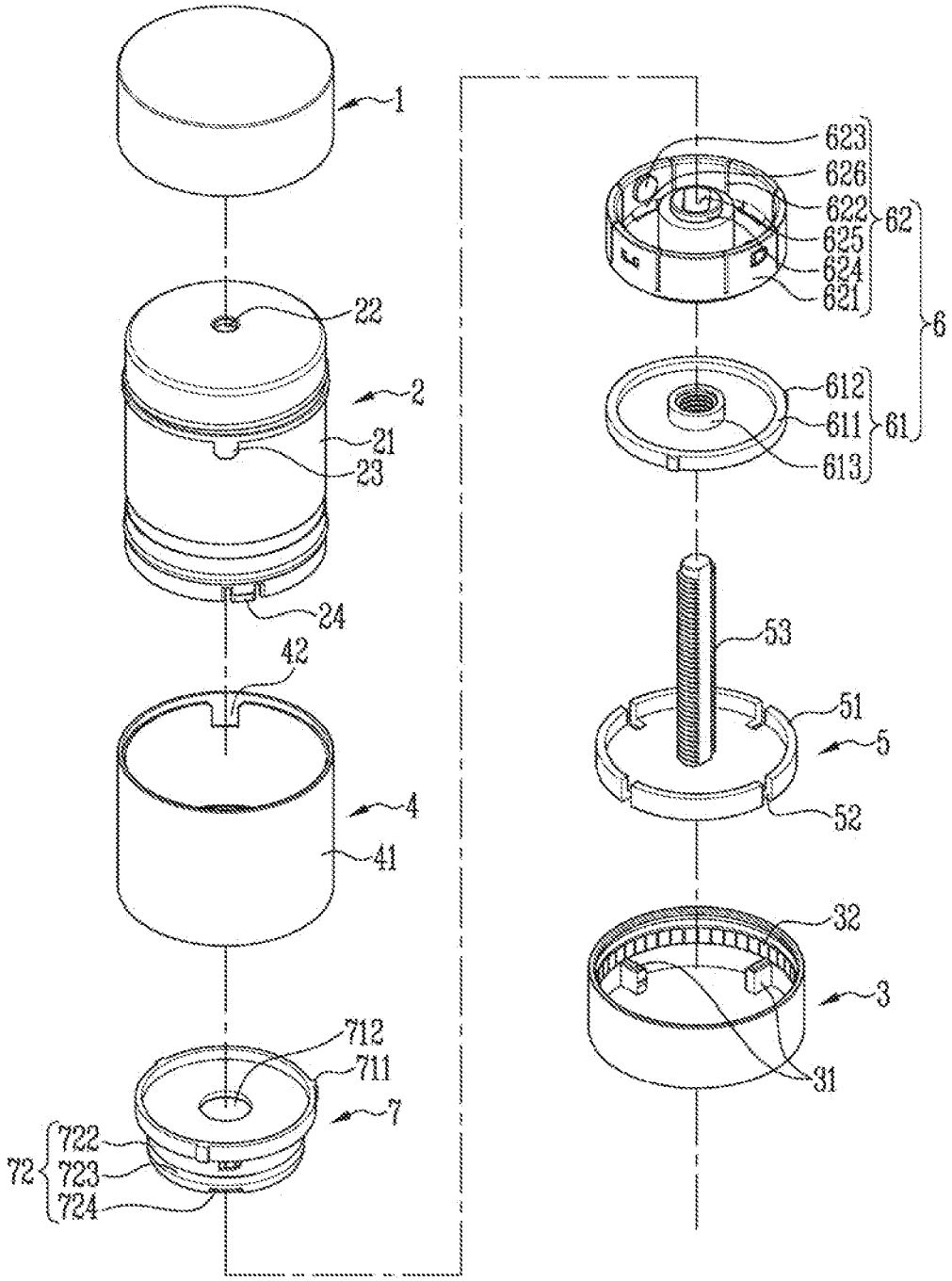
FIG. 2 is a first exploded perspective diagram of a cosmetic vessel according to one embodiment of the present invention.
Figure 3:
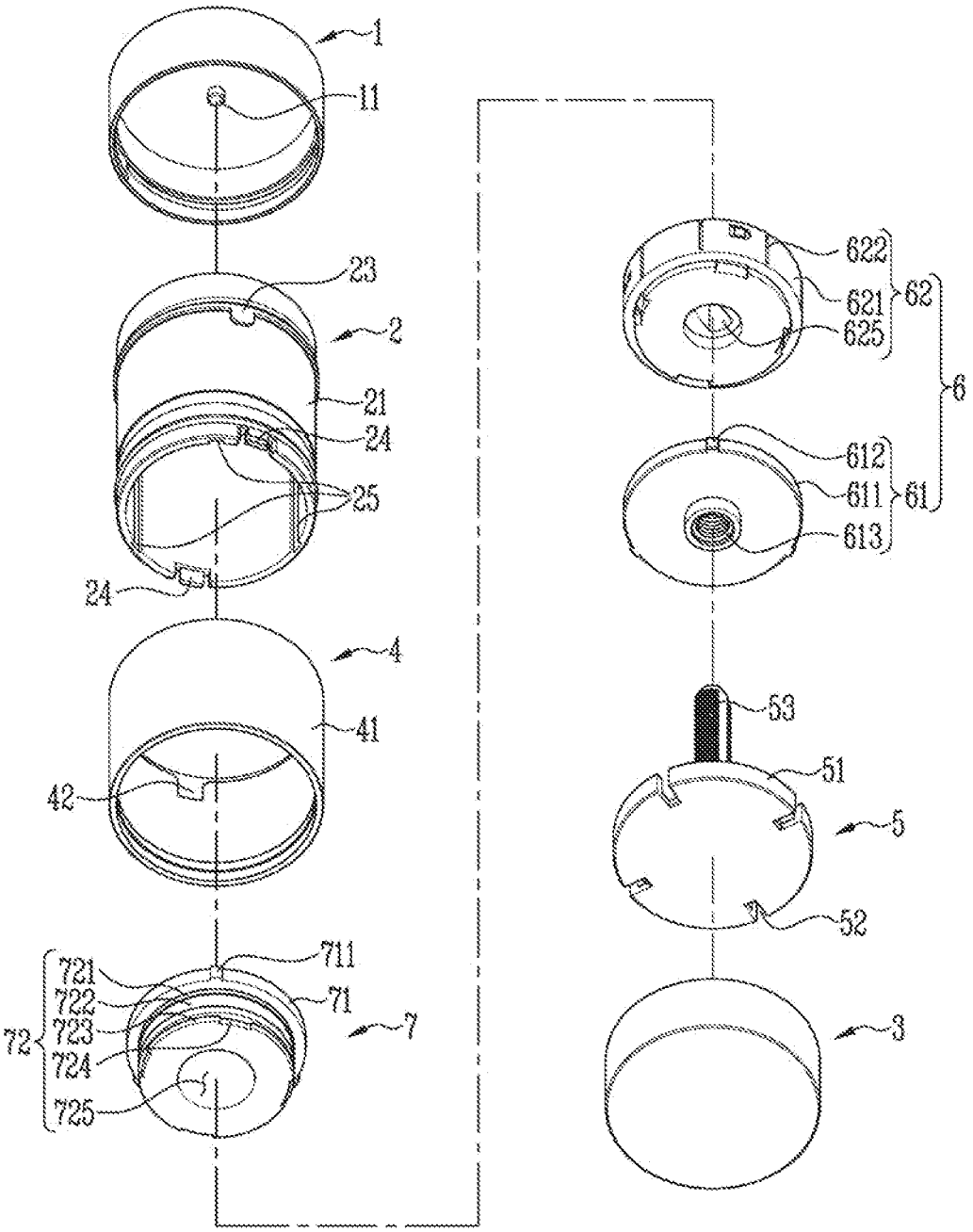
FIG. 3 is a second exploded perspective diagram of a cosmetic vessel according to one embodiment of the present invention.
Figure 4:
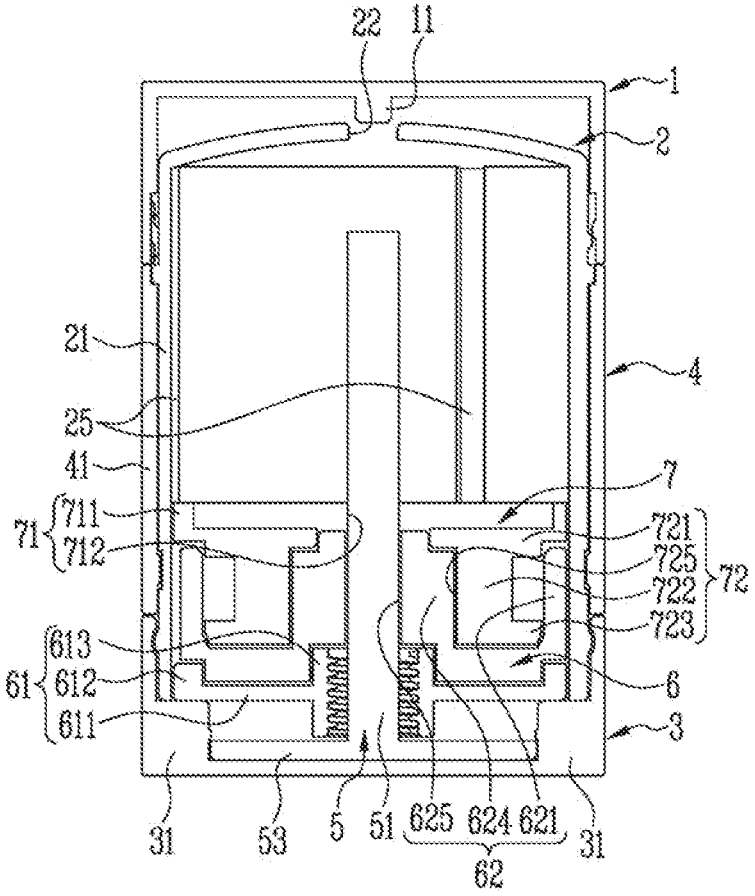
FIG. 4 is a front cross-sectional diagram of a cosmetic vessel according to one embodiment of the present invention.
Figure 5:
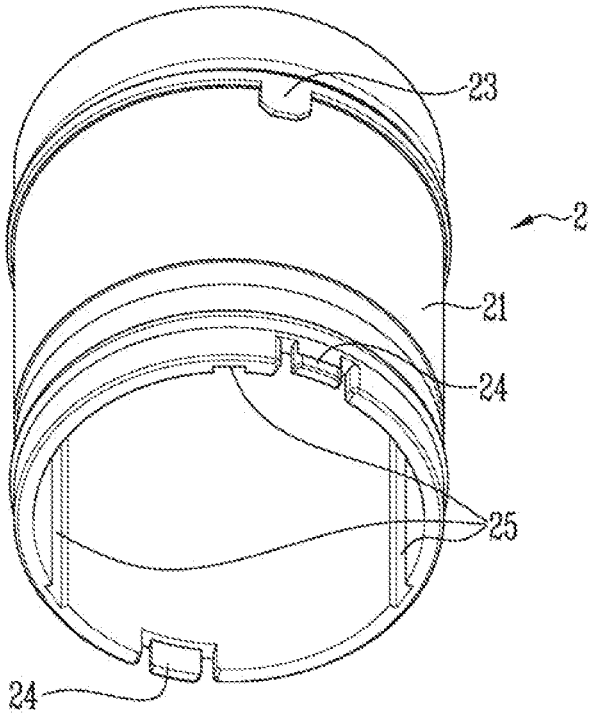
FIG. 5 is an enlarged perspective diagram for explaining a cosmetic vessel of the present invention.
Figure 6:
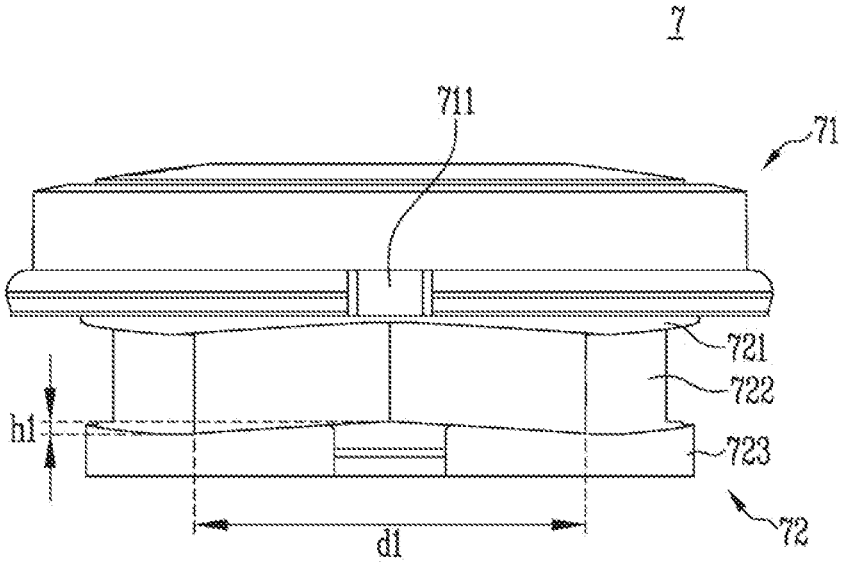
FIG. 6 is an enlarged front diagram for explaining a pressurizing structure portion of the present invention.
Figure 7:
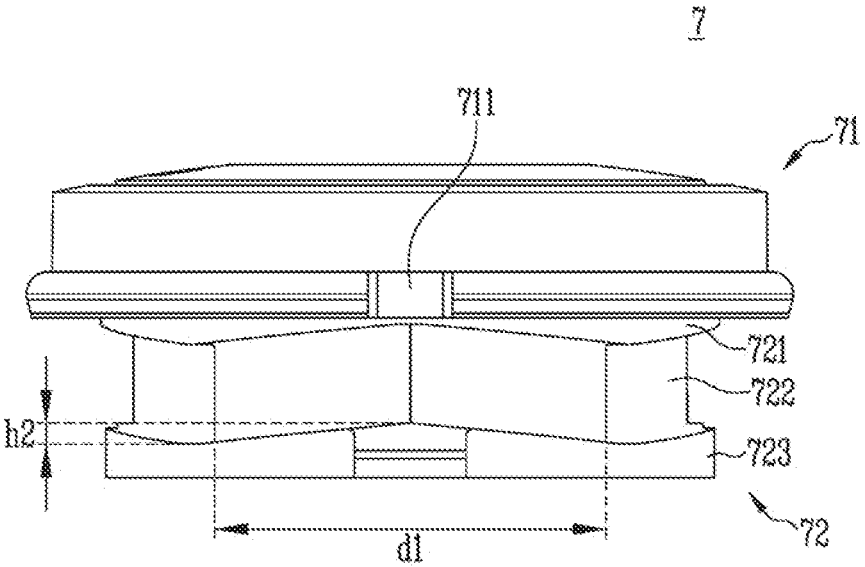
FIG. 7 is an enlarged front diagram for explaining another embodiment of the pressurizing structure portion of FIG. 6.
Figure 8:
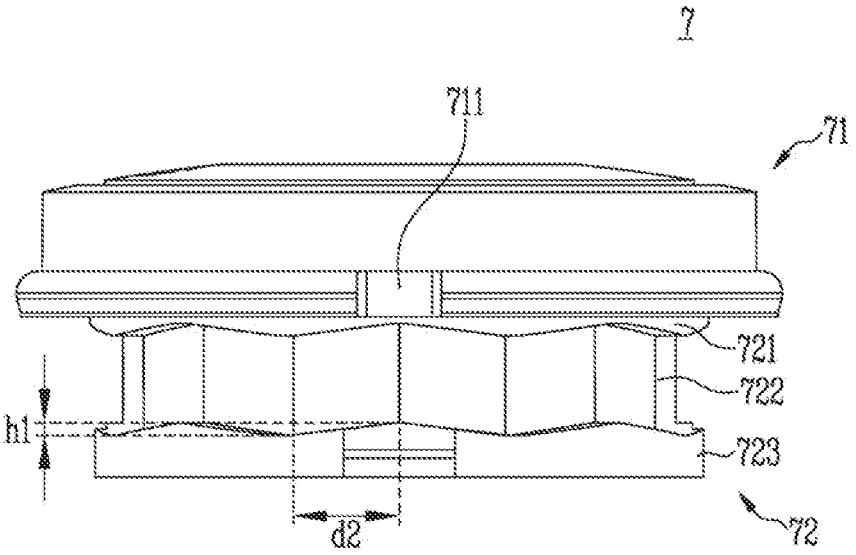
FIG. 8 is an enlarged front diagram for explaining still another embodiment of the pressurizing structure portion of FIG. 6.
Figure 9:
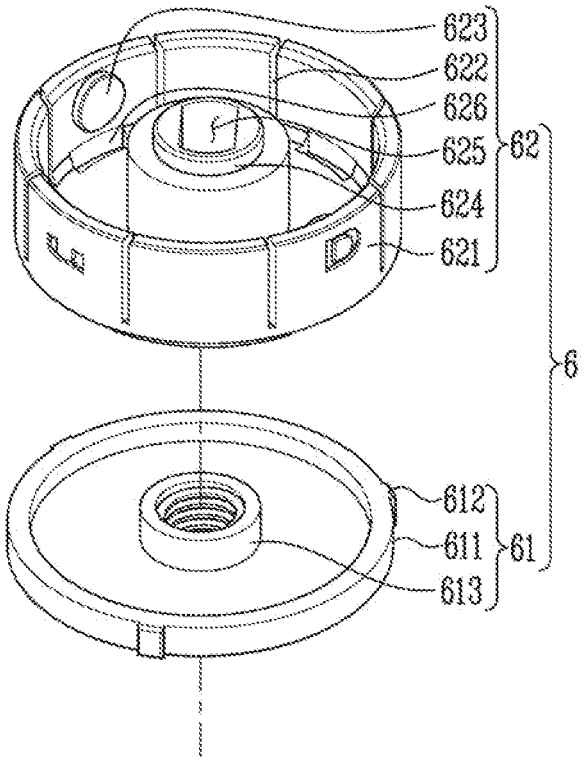
FIG. 9 is an enlarged perspective diagram for explaining an auxiliary portion of the present invention.
Figure 10:
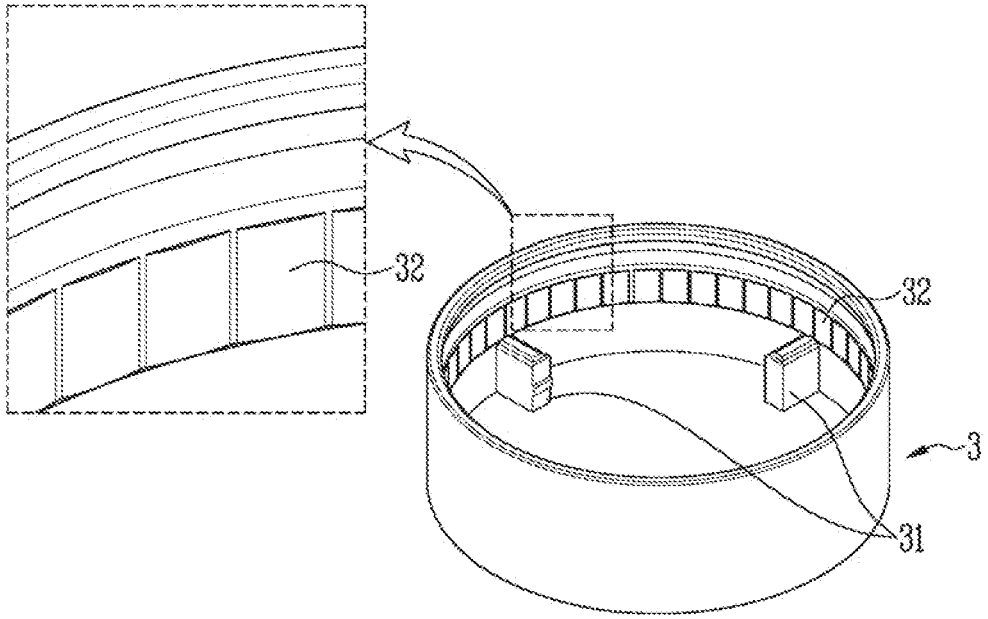
FIG. 10 is an enlarged perspective diagram for explaining a lower cover portion of the present invention.
Figure 11:
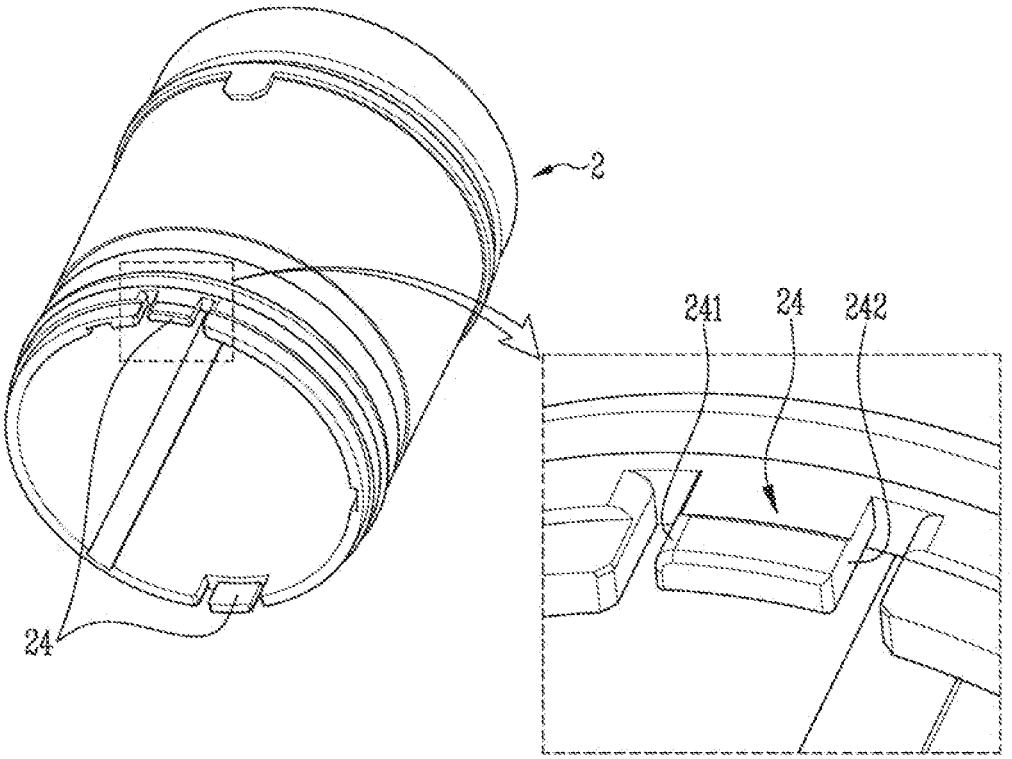
FIG. 11 is an enlarged perspective diagram for explaining another embodiment of a plurality of sound bars of a vessel portion.
Figure 12:
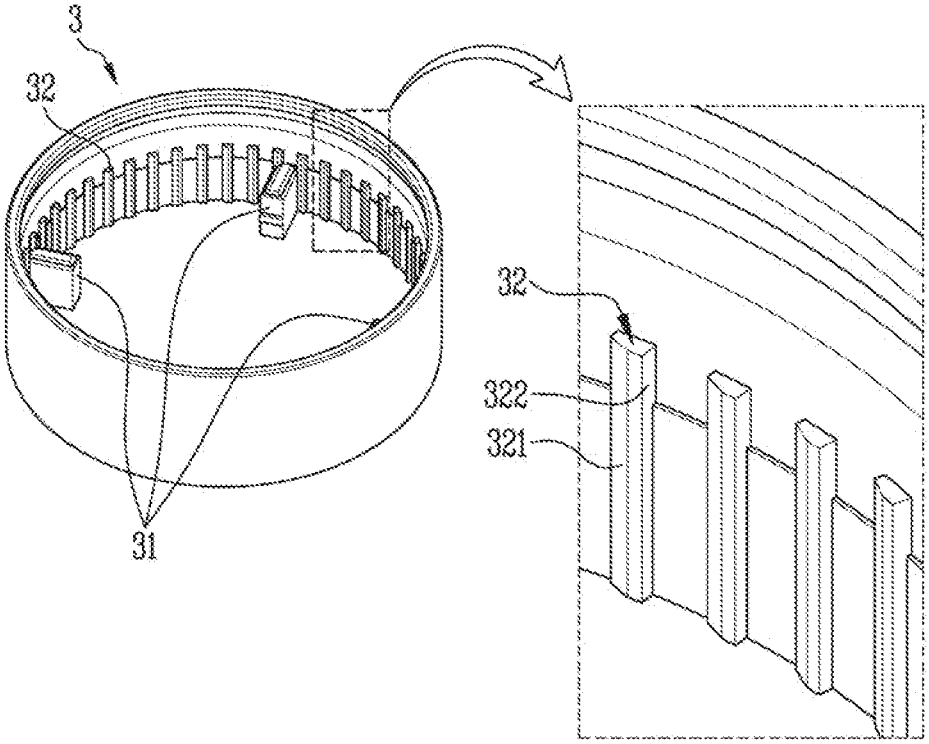
FIG. 12 is an enlarged perspective diagram for explaining another embodiment of a plurality of sound protrusions on a lower cover portion.

FIG. 1 is a perspective diagram of a cosmetic vessel according to one embodiment of the present invention; FIG. 2 is a first exploded perspective diagram of a cosmetic vessel according to one embodiment of the present invention; FIG. 3 is a second exploded perspective diagram of a cosmetic vessel according to one embodiment of the present invention; FIG. 4 is a front cross-sectional diagram of a cosmetic vessel according to one embodiment of the present invention;

FIG. 5 is an enlarged perspective diagram for explaining a cosmetic vessel of the present invention; FIG. 6 is an enlarged front diagram for explaining a pressurizing portion of the present invention; FIG. 7 is an enlarged front diagram for explaining another embodiment of the pressurizing portion of FIG. 6; FIG. 8 is an enlarged front diagram for explaining yet another embodiment of the pressurizing portion of FIG. 6; FIG. 9 is an enlarged perspective diagram for explaining an auxiliary portion of the present invention; FIG. 10 is an enlarged perspective diagram for explaining a lower cover portion of the present invention; FIG. 11 is an enlarged perspective diagram for explaining another embodiment of a plurality of sound bars of a vessel portion; and FIG. 12 is an enlarged perspective diagram for explaining another embodiment of a plurality of sound protrusions on a lower cover portion.

Referring to FIGS. 1 to 10, the cosmetic vessel according to one embodiment of the present invention may be configured such that while pressurizing an interior of a vessel body 21, a pressurizing means rises and upward and downward movements may occur alternately and repeatedly to increase the internal pressure of the vessel body 21 by an upward movement to discharge the contents and dissipate the residual pressure remaining in the vessel body 21 by a downward movement.

More residual pressure remains when the viscosity or hardness of the contents is high. In other words, when the viscosity or hardness of the contents is low, all of the pressure applied to the interior of the vessel body 21 is used to discharge the contents, but when the viscosity or hardness of the contents is high, the speed of discharging the contents becomes slow, thereby leaving a residual pressure, and the user has the inconvenience of having to deal with the contents leaking out due to the residual pressure.

The cosmetic vessel of the present embodiment may include an upper cover portion 1, a vessel portion 2, a lower cover portion 3, a middle portion 4, a shaft portion 5, an auxiliary portion 6, and a pressurizing portion 7.

The cosmetic vessel may include: a vessel portion 2 accommodating the contents in a vessel body 21 provided with a discharge port 22 at an upper portion; a lower cover portion 3 giving a rotational force to an auxiliary portion 6 in a state of gripping a middle portion 4 or gripping a middle portion 4 when it rotates; a middle portion 4 giving a rotational force to an auxiliary portion 6 in a state of gripping a lower cover portion 3 or gripping a lower cover portion 3 when it rotates; a shaft 5 portion provided with a male threaded pillar 53 supported by a fixed plate 51 fixed by a lower cover portion 3 and extending to an upper portion of a vessel body 21; an auxiliary portion 6 elevated and lowered by rotation to elevate and lower a pressurizing portion 7; and a pressurizing portion 7 pressurizing the interior of a vessel body 21 to discharge the contents.

A cosmetic vessel of the present embodiment may be configured such that, when a user rotates a middle portion 4 in a state of gripping a lower cover portion 3 and fixing a shaft 5, a rotational force of a middle portion 4 is transmitted to a vessel body 21, a rotational force of the vessel body 21 is transmitted to an auxiliary portion 6, an auxiliary portion 6 physically rises along a shaft 5, and a residual pressure inside a vessel body 21 is removed by a pressurizing portion 7, which is configured to rise together while an auxiliary portion 6 rises, repeating an upward movement and a downward movement.

In addition, a cosmetic vessel of the present embodiment may be configured such that, when a user grips a middle portion 4 and rotates a lower cover portion 3 to which a shaft 5 is fixed, a rotational force of a lower cover portion 3 is transmitted to an auxiliary portion 6, an auxiliary portion 6 physically rises along a shaft 5, and a residual pressure inside a vessel body 21 is removed by a pressurizing portion 7, which is configured to rise together while an auxiliary portion 6 rises, repeating an upward movement and a downward movement.

The cosmetic vessel of the present embodiment and the contents accommodated in the cosmetic vessel may be included in cosmetic products.

The upper cover portion 1 may seal an upper portion of a vessel portion 2.

The upper cover portion 1 may be provided with a stopper 11 in the inside. A stopper 11 may seal a vessel portion 2 by fitting into a discharge port 22 provided at an upper portion of a vessel portion 2.

A vessel portion 2 may accommodate contents and may include a vessel body 21, a discharge port 22, a plurality of coupling protrusions 23, at least one sound bar 24, and a plurality of guide grooves 25.

Referring to FIG. 5, a vessel body 21 may have a cylindrical shape provided with a discharge port 22 at an upper portion and with an open lower portion. In the present embodiment, a case where a vessel body 21 is cylindrical is described, but of course, it may be implemented in various shapes such as a polygonal shape.

A surface of a vessel body 21 on which a discharge port 22 is provided may have any one shape of convex, concave, and flat shapes, and may be formed of at least one of metal, aluminum, zinc alloy, ceramic, and plastic.

A discharge port 22 may be formed in any one shape of a circular shape and a wavy shape.

A plurality of coupling protrusions 23 may be provided on a part of the upper outer circumferential surface a vessel body 21.

The plurality of coupling protrusions 23 may be coupled with a plurality of coupling grooves 42 provided on an upper inner circumferential surface of an intermediate body 41.

As the vessel body 21 described above may rotate by receiving a rotational force of a middle portion 4, as a plurality of coupling protrusions 23 are coupled with a plurality of coupling grooves 42 of an intermediate body 41.

at least one sound bar 24 may be formed along an edge of an open lower portion of a vessel body 21, and may be formed by cutting a part of a vessel body 21 to have elasticity.

at least one sound bar 24 may generate a sound by friction with a plurality of sound protrusions 32 continuously provided along an inner surface of a lower cover portion 3.

That is, when a vessel body 21 is rotated by rotation of a middle portion 4, at least one sound bar 24 undergo friction with a plurality of sound protrusions 32 to generate a sound.

A plurality of guide grooves 25 may be provided to extend from a lower portion to an upper portion in a groove shape in a constant interval on an inner circumferential surface of a vessel body 21.

A plurality of first guide protrusions 612 provided on an auxiliary portion 6 may be inserted into a plurality of guide grooves 25 and may guide elevating and lowering of an auxiliary portion 6.

In addition, a plurality of second guide protrusions 711 provided on a pressurizing portion 7 may be inserted into a plurality of guide grooves 25 and may guide elevating and lowering of a pressurizing portion 7.

A vessel body 21 configured as described above rotates together when a middle portion 4 is rotated while gripping a lower cover portion 3, thereby transmitting a rotational force of a middle portion 4 to an auxiliary portion 6.

In addition, a vessel body 21 may rotate a lower cover portion 3 while gripping a middle portion 4 to transmit a rotational force of a lower cover portion 3 to an auxiliary portion 6.

A lower cover portion 3 may seal an open lower portion of the vessel body 21 and may include a plurality of fixing bars 31 and a plurality of sound protrusions 32.

A plurality of fixing bars 31 may be provided inside of a lower cover portion 3 and may be coupled to a plurality of insertion grooves 52 provided on an outer circumferential surface of a fixed plate 51 of a shaft portion 5.

A plurality of sound protrusions 32 may be continuously provided along an inner surface of a lower cover portion 3.

As illustrated in FIG. 10, a plurality of sound protrusions 32 may have a gentle hemispherical shape. A plurality of sound protrusions 32 may have various shapes of surfaces with which at least one sound bar 24 come into contact.

A plurality of sound protrusions 32 may generate a sound by friction with at least one sound bar 24 provided along an edge of an open lower portion of a vessel body 21, while a vessel body 21 is rotated.

As such, during a rotation in a direction of discharging the contents, when the shape of a contact surface in a rotation direction and in a reverse rotation direction of a plurality of sound protrusions 32 and at least one sound bar 24 is curved, a sound is generated by friction when rotated in a rotation direction and in a reverse rotation direction, and a user may hear various sounds when the shape of a plurality of sound protrusions 32 is diversified and the material of at least one sound bar 24 that generate a sound is diversified, and so an auditory effect on a user can be expected.

In addition, as illustrated in FIG. 11, at least one sound bar 24 may be formed in a shape where one side has a first inclined surface 241 and the other side has a first vertical surface 242.

In addition, as illustrated in FIG. 12, a plurality of sound protrusions 32 may be formed in a shape where one side has a second inclined surface 321 and the other side has a second vertical surface 322.

In the description above, when at least one sound bar 24 and a plurality of sound protrusions 32 come into contact, a first inclined surface 241 and a second inclined surface 321 come into contact with each other, and a first vertical surface 242 and a second vertical surface 322 come into contact with each other.

Due to this, a plurality of sound protrusions 32 and at least one sound bar 24 may implement a function of a reverse rotation stopper that limits rotation in a reverse direction by a first vertical surface 242 and a second vertical surface 322.

A middle portion 4 may grip a lower cover portion 3 to provide a rotational force to an auxiliary portion 6.

A middle portion 4 may directly provide a rotational force to an auxiliary portion 6, or indirectly provide a rotational force to an auxiliary portion 6 through a vessel body 21. In the present embodiment, a case where a middle portion 4 indirectly provides a rotational force to an auxiliary portion 6 will be described.

A middle portion 4 may be rotated in a forward rotation direction or a reverse rotation direction in a dial manner and may include an intermediate body 41 and a plurality of coupling grooves 42.

An intermediate body 41 may be provided in the form of a shell on an outer circumferential surface of a vessel body 21.

An intermediate body 41 may rotate in a state of being in contact with an outer circumferential surface of a vessel body 21.

A plurality of coupling grooves 42 may be provided on a part of an upper inner circumferential surface of an intermediate body 41 and may be coupled to a plurality of coupling protrusions 23 provided on an upper outer circumferential surface of a vessel body 21.

A middle portion 4 described above may transmit a rotational force to a vessel body 21, as a plurality of coupling grooves 42 are coupled with the plurality of coupling protrusions 23 of a vessel body 21.

In the present embodiment, as described above, an internal residual pressure of a vessel body 21 may be removed by rotating a middle portion 4 in a state of gripping a lower cover portion 3 and fixing a shaft 5.

That is, an operation mechanism of gripping a lower cover portion 3 and rotating a middle portion 4 is that a rotational force of a middle portion 4 is transmitted to a vessel body 21, wherein a rotational force transmitted to a vessel body 21 is transmitted to an auxiliary portion 6, wherein at this time, a first auxiliary portion 61, which is a lower component of an auxiliary portion 6, rotates by a rotational force and rises along a shaft 5, and a second auxiliary portion 62, which is an upper component of an auxiliary portion 6, rises along a shaft 5 by a first auxiliary portion 61, and while an auxiliary portion 6 physically rises along a shaft 5 in such a manner, a pressurizing portion 7 rises and undergoes an upward movement and a downward movement repeatedly, wherein the contents of a vessel body 21 are discharged upon an upward movement of a pressurizing portion 7 and a residual pressure in a vessel body 21 may be removed upon a subsequence downward movement of a pressurizing portion 7.

At this time, a middle portion 4 may directly provide a rotational force to an auxiliary portion 6, or indirectly provide a rotational force to an auxiliary portion 6 through a vessel body 21.

In addition, in the present embodiment, unlike the description above, an internal residual pressure of a vessel body 21 may be removed by rotating a lower cover portion 3, to which a shaft 5 is fixed, in a state of gripping a middle portion 4.

That is, an operation mechanism of gripping a middle portion 4 and rotating a lower cover portion is that a rotational force of a lower cover portion is transmitted to an auxiliary portion 6, wherein at this time, a first auxiliary portion 61, which is a lower component of an auxiliary portion 6, rises only along a shaft 5, and a second auxiliary portion 62, which is an upper component of an auxiliary portion 6 rotates and rises along a shaft 5 by a first auxiliary portion 61, and while an auxiliary portion 6 physically rises along a shaft 5 in such a manner, a pressurizing portion 7 rises and undergoes an upward movement and a downward movement repeatedly, wherein the contents of a vessel body 21 are discharged upon an upward movement of a pressurizing portion 7 and a residual pressure in a vessel body 21 may be removed upon a subsequence downward movement of a pressurizing portion 7.

At this time, lower cover portion 3 may directly provide a rotational force to an auxiliary portion 6, or indirectly provide a rotational force to an auxiliary portion 6 through a vessel body 21.

A shaft portion 5 may be fixed to a lower cover portion 3 to stably fix an auxiliary portion 6 and a pressurizing portion 7 provided inside a vessel body 21.

The shaft portion 5 may rotate together when a lower cover portion 3 rotates, thereby transmitting a rotational force of a lower cover portion 3 to an auxiliary portion 6.

The shaft portion 5 may elevate an auxiliary portion 6 and may guide elevation of a pressurizing portion 7.

A shaft portion 5 may include a fixed plate 51, a plurality of inserting grooves 52, and a male threaded pillar 53.

A fixed plate 51 may be fixed to a lower cover portion 3.

A plurality of inserting grooves 52 may be provided in a constant interval on an outer circumferential surface of a fixed plate 51.

A plurality of inserting grooves 52 may be coupled to a plurality of fixing bars 31 provided inside of a lower cover portion 3, thereby fixing a shaft portion 5 to a lower cover portion 3.

A male threaded pillar 53 may be provided to be supported by a fixed plate 51 and to extend to an upper portion of a vessel body 21. A male threaded column 53 may have a screw thread, and the pitch spacing of the thread may vary.

A male threaded pillar 53 may be screwed to a female threaded member 613 of a first auxiliary portion 61 and cause a first auxiliary portion 61 to move upwards and downwards while rotating.

In addition, a male threaded pillar 53 may be inserted into a second insertion hole 712 of a head portion 71 to guide a head portion 71 in being elevated and lowered.

An auxiliary portion 6 may receive a rotational force from a vessel body 21 or a shaft portion 5 to move upwards and downwards along a male threaded pillar 53 while rotating, thereby elevating and lowering a pressurizing portion 7.

An auxiliary portion 6 may elevate and lower a pressurizing portion 7 by rotation while moving upwards and downwards and may include a first auxiliary portion 61 and a second auxiliary portion 62. In the present embodiment, a case where a first auxiliary portion 61 and a second auxiliary portion 62 are separated is described, but of course, they may be formed in an integrated shape.

A first auxiliary portion 61 and a second auxiliary portion 62 may be provided between a shaft portion 5 and a pressurizing portion 7.

A first auxiliary portion 61 may be provided between a shaft portion 5 and a second auxiliary portion 62 and may include a support plate 611, a plurality of first guide protrusions 612, and a female threaded member 613.

A support plate 611 may be seated on a fixed plate 51 of a shaft portion 5 and may accommodate a lower portion of a second auxiliary portion 62.

A plurality of first guide protrusions 612 may be provided on an outer circumferential surface of a support plate 611, and a female threaded member 613 screwed to a male threaded pillar 53 of a shaft portion 5 may be provided at the center.

A plurality of first guide protrusions 612 may be provided on an outer circumferential surface of a support plate 611.

A plurality of first guide protrusions 612 may be inserted into a plurality of guide grooves 25 of a vessel body 21 and receive a rotational force from a vessel body 21 to cause a first auxiliary portion 61 to move upwards and downwards along an internal surface of a vessel body 21.

A female threaded member 613 may be provided at the center of a support plate 611.

A female threaded member 613 may be screwed to a male threaded pillar 53 of a shaft portion 5 and receive a rotational force from a vessel body 21 to move upwards and downwards along a male threaded pillar 53 while rotating to elevate and lower a pressurizing portion 7.

A second auxiliary portion 62 may be provided between a first auxiliary portion 61 and a pressurizing portion 7 and include a rim 621, a cut groove 622, a plurality of pressurizing protrusions 623, a coupling pillar 624, a first insertion hole 625, and a fixing protrusion 626.

A second auxiliary portion 62 may be coupled to a pressurizing structure portion 72 of a pressurizing portion 7 in a state of being accommodated in a first auxiliary portion 61.

A rim 621 may have a plurality of cut grooves 622 formed in a constant interval to accommodate a pressurizing structure portion 72 and to have elasticity.

Cut grooves 622 may cause a rim 621 to have elasticity when a plurality of pressurizing protrusions 623 provided inside of a rim 621 rotate in a state where they are inserted into a pressurizing guideline with a curved surface provided on a pressurizing structure portion 72.

Here, as will be described later, a pressurizing guideline may be formed in a pressurizing structure portion 72 to have a shape curved up and down by a first annular member 721 having a first wave shape, a second annular member 722, and a third annular member 723 having a second wave shape, and may cause a head portion 71 to repeatedly undergo an upward movement and a downward movement alternately.

A plurality of pressurizing protrusions 623 may be provided on an inner side surface of a rim 621 and may be inserted into a pressurizing guideline. Although a plurality of pressurizing protrusions 623 is illustrated as two in a drawing, they may be four, but are not limited thereto.

A plurality of pressurizing protrusions 623 rotate around a pressurizing structure portion 72 along a pressurizing guideline, causing a head portion 71 to repeatedly undergo an upward movement and a downward movement alternately.

While a plurality of pressurizing protrusions 623 rotate and rise in a state of being inserted into a pressurizing guideline and move from a crest portion to a trough portion of a first wave shape, may cause a head portion 71 to undergo an upward movement. Accordingly, the contents accommodated in a vessel body 21 may be discharged through a discharge port 22 as the internal pressure of a vessel body 21 increases due to an upward movement of a head portion 71.

In addition, while a plurality of pressurizing protrusions 623 rotate and rise in a state of being inserted into a pressurizing guideline and move from a trough portion to a crest portion of a first wave shape may cause a head portion 71 to undergo a downward movement. Accordingly, the contents accommodated in a vessel body 21 are prevented from being leaked as the residual pressure is dissipated because the internal pressure of a vessel body 21 is decreased due to a downward movement of a head portion 71.

A coupling pillar 624 may be provided to protrude upward from the center of a rim 621.

A coupling pillar 624 may have a size to be inserted into a coupling hole 725 of a pressurizing structure portion 72.

The coupling pillar 624 may be provided with a first insertion hole 625 penetrated upward and downward.

A male threaded pillar 53 of a shaft portion 5 may be inserted into a first insertion hole 625.

A coupling pillar 624 has a certain height, and as a male threaded pillar 53 is inserted into a first insertion hole 625 penetrated in a height direction, it causes a second auxiliary portion 62 to stably move upwards and downwards without shaking at male threaded pillar 53.

In addition, a first insertion hole 625 may be inserted into a second insertion hole 712 to minimize or block a space between a male threaded pillar 53 and a second insertion hole 712, thereby preventing the contents from leaking to a lower end.

A fixing protrusion 626 may be provided on an inner lower portion of a rim 621.

A fixing protrusion 626 may be fixed to a fixing groove 724 of a pressurizing structure portion 72 so that a pressurizing structure portion 72 may be fixedly seated on a second auxiliary portion 62.

A pressurizing portion 7 may pressurize the interior of a vessel body 21 to discharge the contents.

While a pressurizing portion 7 is elevated by an auxiliary portion 6 and pressurizes the interior of a vessel body 21 to discharge the contents of a vessel body 21, upward and downward movements may occur alternately and repeatedly.

A pressurizing portion 7 may increase the internal pressure of a vessel body 21 through an upward movement to discharge the contents and may dissipate a residual pressure remaining in a vessel body 21 through a downward movement.

Such a pressurizing portion 7 may include a head portion 71 and a pressurizing structure portion 72.

A head portion 71 may be provided to be in close contact with an inner circumferential surface of a vessel body 21.

While a head portion 71 moves upwards and downwards, upward and downward movements may occur alternately and repeatedly by a pressurizing structure portion 72, which may increase the internal pressure of a vessel body 21 through an upward movement to discharge the contents and may dissipate a residual pressure remaining in a vessel body 21 through a downward movement.

A plurality of second guide protrusions 711 may be provided on an outer circumferential surface of a head portion 71.

A plurality of second guide protrusions 711 may be inserted into a plurality of guide grooves 25 provided on an inner surface of a vessel body 21 and may guide elevating and lowering of a head portion 71 according to elevating and lowering of an auxiliary portion 6.

A pressurizing structure portion 72 may be coupled to an auxiliary portion 6 at a lower portion of a head portion 71.

A pressurizing structure portion 72 may be configured to alternately and repeatedly cause upward and downward movements of a head portion 71 while a head portion 71 moves upwards and downwards and may include a first annular member 721, a second annular member 722, a third annular member 723, a fixing groove 724, and a coupling hole 725.

A first annular member 721 may be connected to a head portion 71.

A first annular member 721 may have a diameter smaller than the diameter of a head portion 71, and a lower surface thereof may form a first wave shape.

A second annular member 722 may be connected to a first annular member 721.

A second annular member 722 may have a diameter smaller than the diameter of a first annular member 721.

A third annular member 723 may be connected to a second annular member 722.

A third annular member 723 may have the same diameter as a first annular member 721, and an upper surface thereof may form a third wave shape.

The first annular member 721 and the third annular member 723 described above have a shape curved up and down by a first wave shape and a second wave shape, and a pressurizing guideline may cause a head portion 71 to repeatedly undergo an upward movement and a downward movement alternately.

While the plurality of pressurizing protrusions 623 rotate and rise in a state of being inserted into the pressurizing guideline and undergo a rotational operation in one cycle from a crest portion of a first wave shape or a second wave shape to another neighboring crest portion, the pressurizing portion 72 configured as described above may cause the contents to be discharged once.

In the above, as shown in FIGS. 6 to 8, each of a first wave shape or a second wave shape may be a sine wave shape of a same period with repeated trough portions and crest portions.

A first wave shape of a first annular member 721 and a third wave shape of a third annual member 723 may have coinciding trough portions and crest portions of a sine wave shape Referring to FIG. 6, in a pressurizing structure portion 72 configured as described above, the crest portions and trough portions of each of a first wave shape of a first annular member 721 and a third wave shape of a third annual member 723 may be formed to have a first height difference h1 therebetween.

In addition, in a pressurizing structure portion 72, a distance between a trough portion of a first wave shape of a first annular member 721 or of a second wave shape of a third annular member 723 and another neighboring trough portion thereof or between a crest portion and another neighboring crest portion thereof may be formed to have a first distance value d1. Here, a first wave shape of a first annular member 721 may be a reference, because, even when a third annular member 723 does not have a second wave shape, a pressurizing structure portion 72 may undergo an upward movement and a downward movement by a first wave shape. In other words, when a plurality of pressurizing protrusions 623 rotate along a first wave shape of a first annular member 721 and pass a trough portion and a crest portion in a state of being inserted to a pressurizing guideline, a pressurizing structure portion 72 may undergo an upward movement and a downward movement, but an upward movement and a downward movement of a pressurizing structure portion 72 may not be implemented only with a second wave shape of a second annular member 722.

In the above description, a pressurizing structure portion 72 can effectively deal with a residual pressure difference which is dependent upon the viscosity or hardness of the contents by adjusting a first height difference value h1.

In addition, a pressurizing structure portion 72 may adjust the number of discharge of the contents and the discharged amount of the contents based on a rotation of 360 degrees by adjusting a first distance value d1 or angle (based on a circle) and can effectively deal with a residual pressure difference which is dependent upon the hardness by repeatedly undergoing an upward movement and a downward movement several times while rotating 360 degrees. Here, one time of discharge and one-time discharged amount are defined as a pressurizing protrusion 623 rotating and rising in a state of being inserted to a pressurizing guideline and moving from a crest portion of a first wave shape of a first annular member 721 or of a second wave shape of a third annular member 723 through a trough portion to a next crest portion. In other words, the contents are discharged once while moving from a crest portion to a trough portion.

Referring to FIG. 7, in a pressurizing structure portion 72*a* of another embodiment, a distance between a trough portion of a first wave shape of a first annular member 721 or of a second wave shape of a third annular member 723 and another neighboring trough portion thereof or between a crest portion and another neighboring crest portion thereof is the same first distance difference d1 as a pressurizing structure portion 72 illustrated in FIG. 6, but a crest portion and a trough portion of each of a first wave shape of a first annular member 721*a* and a third wave shape of a third annual member 723*a* have a second height difference h2 therebetween, which is greater than a first height difference h1 of a pressurizing structure portion 72 illustrated in FIG. 6.

As such, a pressurizing structure portion 72*a* of another embodiment may have a second height difference h2, which is greater than a first height difference h1 of a pressurizing structure portion 72, so that a difference between the amount of an upward movement and the amount of a downward movement of a head portion 71 may be increased. The amount of the dissipated amount of the residual pressure inside a vessel body 21 is increased as the amount of a downward movement of a head portion 71 is increased.

Referring to FIG. 8, in a pressurizing structure portion 72*b* of still another embodiment, a crest portion and a trough portion of each of a first wave shape of a first annular member 721*b* and a third wave shape of a third annual member 723*b* have the same first height difference h1 therebetween as a pressurizing structure portion 72 illustrated in FIG. 6, but a distance between a trough portion of a second wave shape of a second annular member 722*b* and a neighboring trough portion thereof or between a crest portion and a neighboring crest portion thereof is a second distance difference d2, which is smaller than a first distance difference d1 of a pressurizing structure portion 72 illustrated in FIG. 6.

As such, a pressurizing structure portion 72*b* of still another embodiment has a second distance value d2, which is smaller than a first distance value d1 of a pressurizing structure portion 72, so that the number of times of discharge of the contents is increased and the amount of discharge of the contents is decreased while rotating 360 degrees. In other words, in a second distance value d2, which is smaller than a first distance value d1 of a pressurizing structure portion 72, the period of one cycle is shorter so that the number of times of discharge of the contents is increased and the amount of discharge of the contents is decreased.

As described above, as a height difference between a crest portion and a trough portion of each of a first wave shape and a second wave shape is increased, a pressurizing portion 7 may increase the amount of a downward movement of a head portion 71, thereby increasing the dissipated amount of a residual pressure inside a vessel body 21. At this time, the height difference may be in a range of 0.25 mm to 1 mm, or a specific dimension, for example, 0.25 mm, 0.35 mm, 0.45 mm, and 0.45+@ mm, may be designated.

In addition, as a distance value between a trough portion of a first wave shape or a second wave shape and another neighboring trough portion thereof or between a crest portion and a neighboring crest portion thereof is decreased, a pressurizing portion 7 may increase the number of times of discharge of the contents and decrease the amount of discharge of the contents based rotation of 360 degrees. At this time, an angle value may be any one of 22.5 degrees, 45 degrees, and 90 degrees based one cycle, and as described later, it may be any one of 9 degrees and 18 degrees. Of course, a specific angle may be designated without being limited thereto. A distance value is proportional to an angle value, and at this time, a distance value may be a distance corresponding to any one of 9 degrees, 18 degrees, 22.5 degrees, 45 degrees, and 90 degrees based one cycle, but it is not limited thereto.

Figure 13:
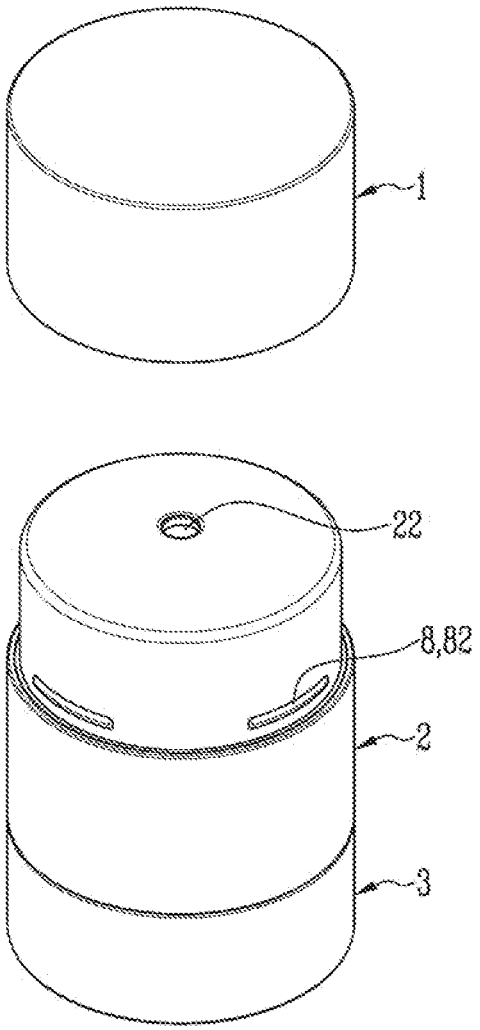
FIG. 13 is a perspective diagram of a cosmetic vessel according to another embodiment of the present invention.
Figure 14:
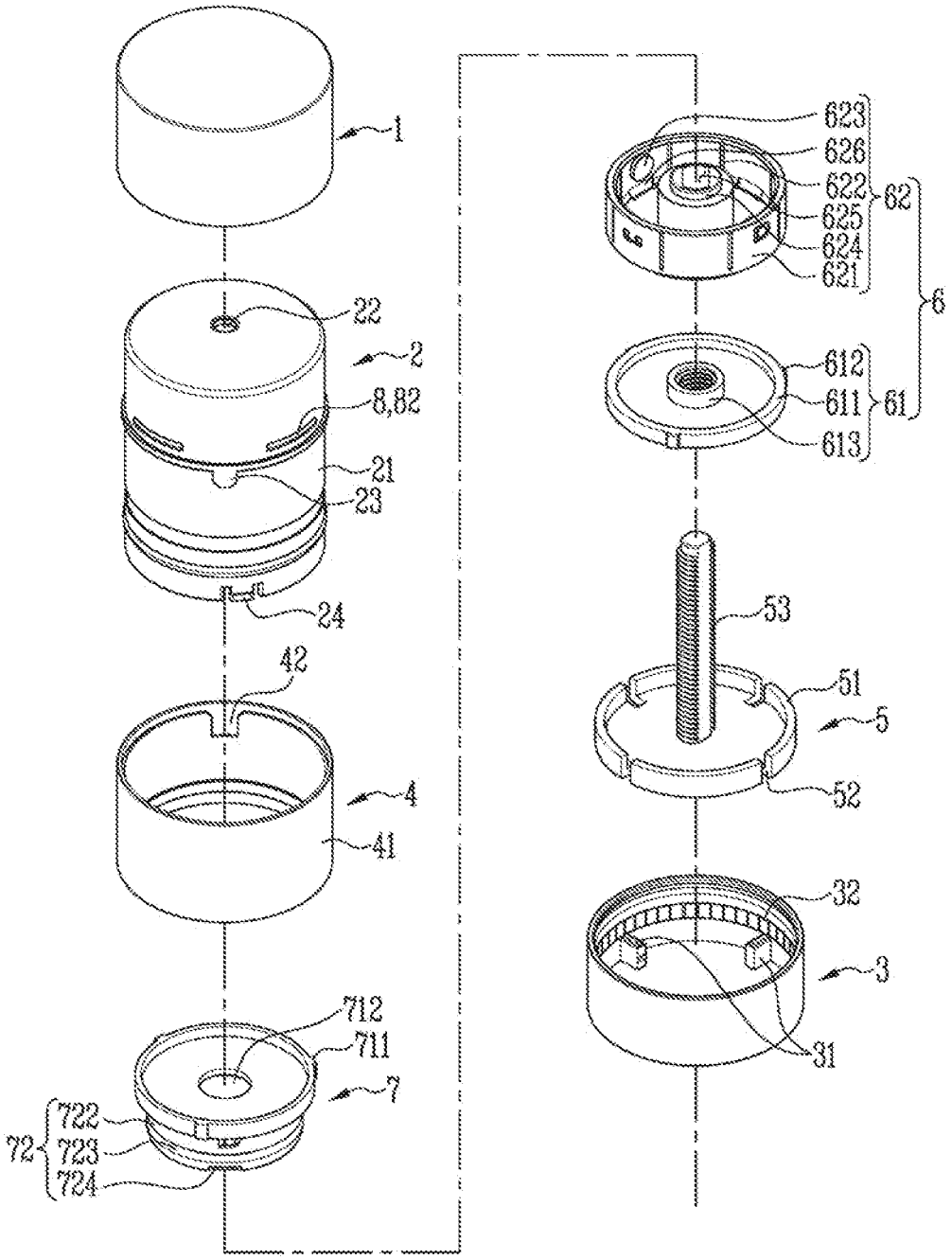
FIG. 14 is a first exploded perspective diagram of a cosmetic vessel according to another embodiment of the present invention.
Figure 15:
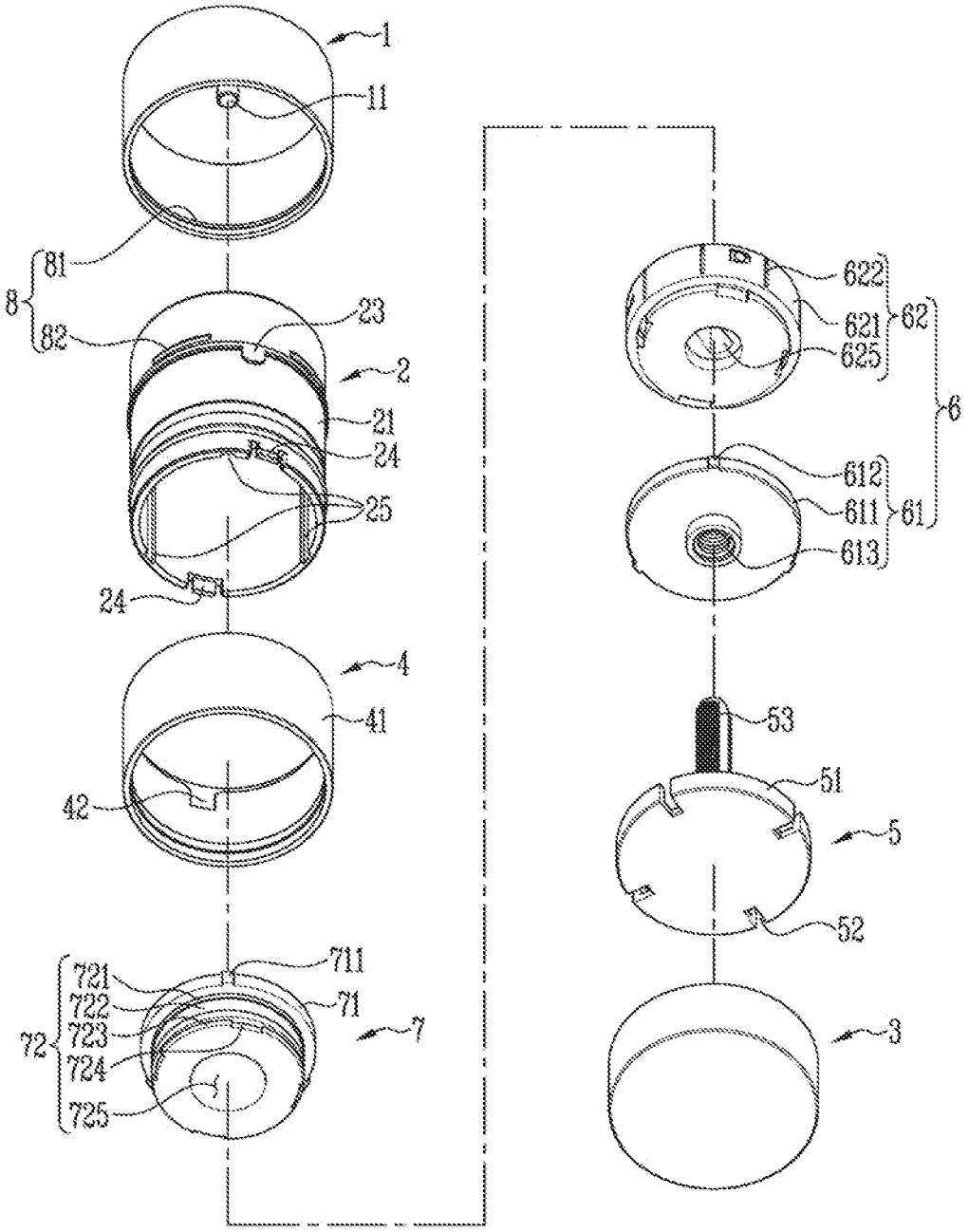
FIG. 15 is a second exploded perspective diagram of a cosmetic vessel according to another embodiment of the present invention.
Figure 16:
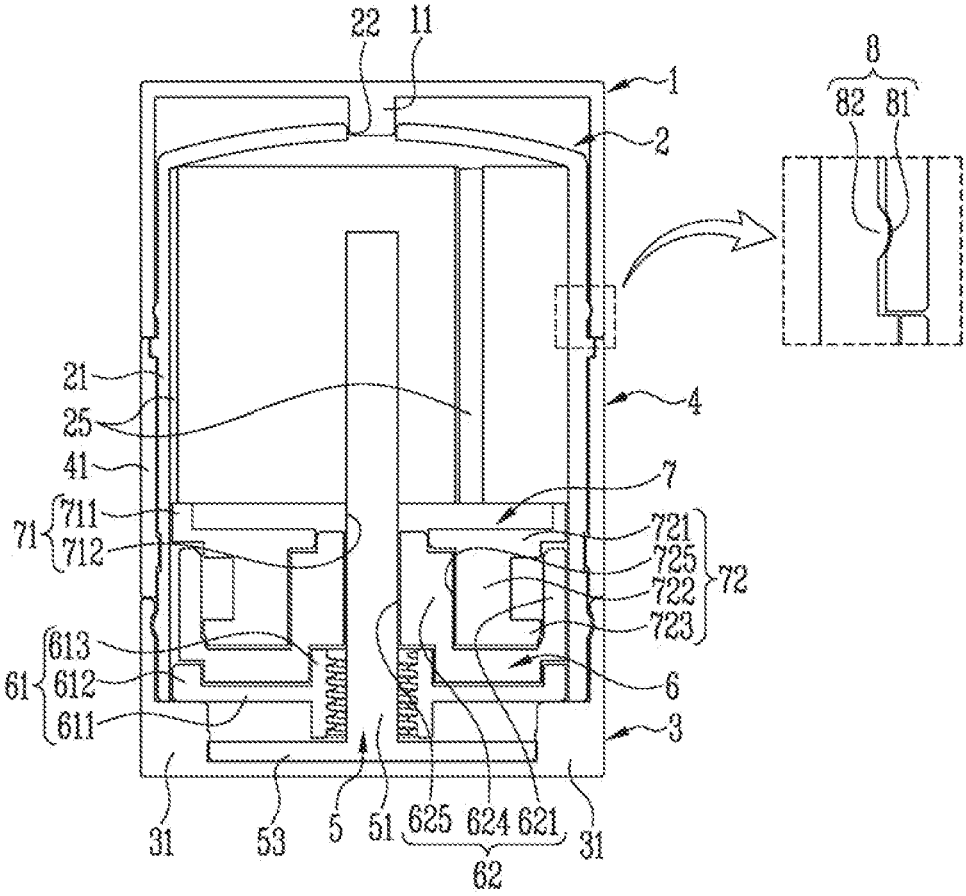
FIG. 16 is a front cross-sectional diagram of a cosmetic vessel according to another embodiment of the present invention.

FIG. 13 is a perspective diagram of a cosmetic vessel according to another embodiment of the present invention; FIG. 14 is a first exploded perspective diagram of a cosmetic vessel according to another embodiment of the present invention; FIG. 15 is a second exploded perspective diagram of a cosmetic vessel according to another embodiment of the present invention; and FIG. 16 is a front cross-sectional diagram of a cosmetic vessel according to another embodiment of the present invention.

Referring to FIGS. 13 to 16, a cosmetic vessel according to yet another embodiment of the present invention may be configured such that, while the inside of a vessel body 21 is pressurized, a pressuring means is elevated to cause an upward movement and a downward movement alternately and repeatedly to increase the internal pressure of the vessel body 21 by the upward movement so that the contents may be discharged and the residual pressure remaining in the vessel body 21 may be dissipated by the downward movement.

The cosmetic vessel of the present embodiment may include an upper cover portion 1, a vessel portion 2, a lower cover portion 3, a middle portion 4, a shaft portion 5, an auxiliary portion 5, a pressurizing portion 7, and a fastening means 8.

In yet another embodiment of the present invention, since the remaining features 1, 2, 3, 4, 5, 6, 7 except for a fastening means 8 are identical to each feature of the previously described embodiment of the present invention, the same reference numerals were used. Accordingly, to avoid duplication of explanation, detailed description of each of the same features is omitted here, and only a fastening means 8, which is a different feature from the previously described embodiment of the present invention, and parts that are changed thereby will be described.

A vessel portion 2 may be fastened to an upper cover portion 1 by a fastening means 8.

A fastening means 8 of the present embodiment may include: a fastening groove 81 provided along an inner circumferential surface of an upper cover portion 1; and a fastening protrusion 82 provided continuously or discontinuously along an inner circumferential surface of a vessel body 21 and fastened to the fastening groove 81 in a snap-on fastening manner without horizontal restraining.

In above description, when a lower cover portion 3 rotates in a state where an upper cover portion 1 is fastened to a vessel portion 2, a fastening means 8 may cause the lower cover portion 3 to rotate idle with respect to the upper cover portion 1 so that a rotational force of the lower cover portion 3 is not transferred to the shaft portion 5, thereby preventing the contents from being discharged.

In the cosmetic vessel of the present embodiment, compared to the cosmetic vessel of the previously described embodiment, the size of a vessel portion 2 may be the same but the size of an upper cover portion 1 and a middle portion 4 may be different.

In other words, the upper cover portion 1 of the present embodiment may be larger than the size (height) of the upper cover portion 1 of the previously described embodiment, and the middle portion 4 of the present embodiment may be smaller than the size (height) of the middle portion 4 of the previously described embodiment.

This allows to implement the purpose of the present embodiment, which is to prevent the contents from being unnecessarily discharged in addition to a fastening means 8, by increasing the size (height) of an upper cover portion 1 so that a user may easily grip the upper cover portion 1 rotating idle with respect to a lower cover portion 3 in a state where the upper cover portion 1 is fastened to a vessel portion 2, and by decreasing the size (height) of a middle portion 4 so that a user may not easily grip the rotating middle portion 4 in a state where the upper cover portion 1 is fastened to a vessel portion 2.

As described above, a cosmetic vessel according to one embodiment or another embodiment of the present invention may cause a sound to be generated by a sound bar 24 of a vessel portion 2 and a sound protrusion 32 of a lower cover portion 3 when a lower cover portion 3 or the like is rotated to use the contents. In this case, the sound is generated simply in a constant interval while the contents are discharged.

In addition, together with a sound bar 24 of a vessel portion 2 and a sound protrusion 32 of a lower cover portion 3 that generate a sound, a cosmetic vessel according to one embodiment or another embodiment of the present invention may be provided with a pressurizing structure portion 72, which causes a pressurizing portion 7 to rotate and rise to repeatedly and independently undergo an upward movement (discharging the contents once by pressurization) and a downward movement (preventing the contents from being discharged by dissipating the residual pressure), when a lower cover portion 3 or the like is rotated to use the contents. In this case, the cosmetic vessel may be configured so that the sound may be generated in a constant interval regardless of the number of times of discharging the contents or the sound may be generated in a manner interlocked with the number of times of discharging the contents as described below with reference to FIG. 17.

Figure 17:
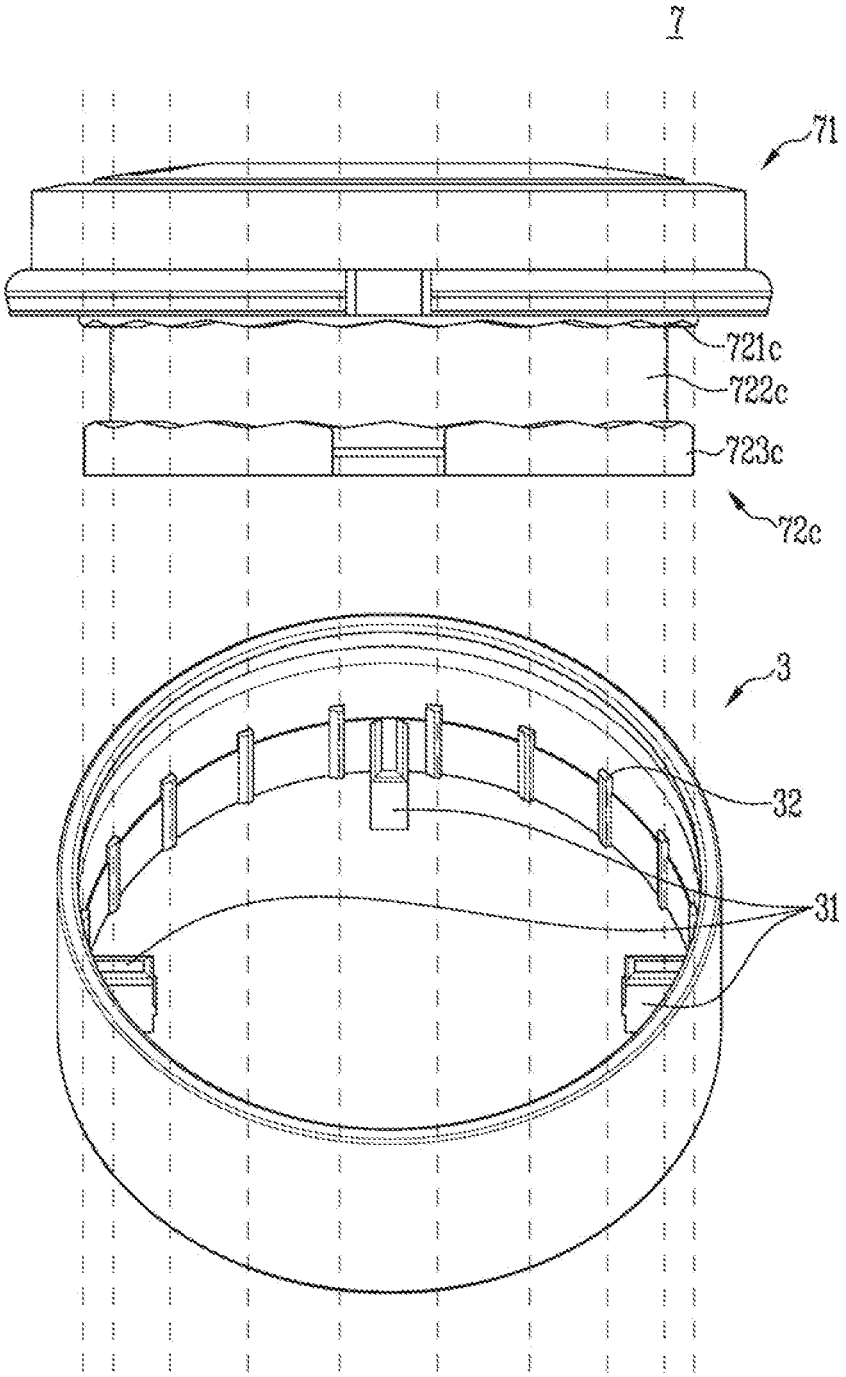
FIG. 17 is a diagram for explaining that sound is generated each time the contents are discharged once by adjusting the number or angle of sound protrusions of a lower cover portion and pressurizing structure portion of a pressurizing portion, respectively.

FIG. 17 is a diagram for explaining that sound is generated each time the contents are discharged once by adjusting the number or angle of sound protrusions of a lower cover portion and pressurizing structure portion of a pressurizing portion, respectively.

To explain an interlocked relationship between the number of times of discharging the contents and the sound, FIG. 17 shows a pressurizing portion 7 in which a pressurizing structure portion 72*c* is provided; and a lower cover portion 3 in which a sound protrusion 32 is provided.

A pressurizing structure portion 72*c* may include a first annular member 721*c* having a first wave shape; a second annular member 722*c*; and third annular member 723*c*.

Hereinafter, referring to FIG. 17 together with one embodiment described with reference to FIGS. 1 to 12 and another embodiment described with reference to FIGS. 13 to 16, an interlocked relationship between the number of times of discharging the contents and the sound is described.

In a cosmetic vessel according to one embodiment or another embodiment, each time a pressurizing portion 7 undergoes one cycle of rotational operation from a crest portion of a first wave shape provided in a first annular member 721*c* through a trough portion to another neighboring crest portion, any one of a plurality of sound protrusions 32 undergoes friction with a sound bar 24 once to generate a sound.

At this time, in the process where the pressurizing portion 7 undergoes one cycle of rotational operation, the contents are discharged once while moving from a crest portion to a trough portion (upward movement of the pressurizing portion 7) but are not discharged while moving from a trough portion to another crest portion (downward movement of the pressurizing portion 7).

An interlocked relationship between the number of times of discharging the contents and the sound is described in Table 1 below.

TABLE 1

| Angle value of one cycle of a pressurizing portion | Total number of times of upward/downward movement of a pressurizing portion based on 360 degrees | Arrangement angle value of sound protrusions | Total number of sound protrusions based on 360 degrees | Total number of times of discharging the contents based on 360 derees |
|---|---|---|---|---|
| 90 | 8 | 90 | 4 | 4 |
| 45 | 16 | 45 | 8 | 8 |
| 30 | 24 | 30 | 12 | 6 |
| 22.5 | 32 | 22.5 | 16 | 8 |
| . | . | . | . | . |
| . | . | . | . | . |
| . | . | . | . | . |
| 18 | 40 | 18 | 20 | 20 |
| 9 | 80 | 19 | 40 | 40 |

FIG. 17 shows a case in which the angle value of one cycle of a pressurizing portion 7 is 18 degrees and the total number of sound protrusions 32 is 20 in Table 1.

Referring to Table 1, the angle value of one cycle of a pressurizing portion 7 may be a value obtained by dividing 360 degrees by the total number of sound protrusions 32. The total number of sound protrusions is preferably a multiple of 4. Through this, the angle value may be an integer (or 22.5 degrees), which is a value that is convenient for manufacturing a vessel. In other words, the angle value of one cycle of a pressurizing portion 7 may correspond to a value obtained by dividing 360 degrees by a multiple of 4.

A plurality of sound protrusions may be arranged in a constant interval on an inner circumferential surface of a lower cover portion 3 in a number corresponding to a value obtained by dividing a sum of the number of times of upward movement of a pressurizing portion 7 and the number of times of downward movement by 2.

In addition, the angle value of one cycle of a pressurizing portion 7 may be an arrangement angle value at which a plurality of sound protrusions 32 are arranged in a constant interval on an inner circumferential surface of the lower cover portion 3.

As shown in FIG. 7, each of a plurality of sound protrusions 32 may be arranged to correspond to a trough portion of a first wave shape, which is a point where discharge of the contents is completed once, so that, when a lower cover portion 3 or the like is rotated to use the contents, any one of the plurality of sound protrusions 32 passes through a sound bar 24 of a vessel portion 2 to generate a sound, and the number of times of discharge of the contents is confirmed.

In the above, the present invention has been described focusing on the embodiments of the present invention, but this is only an example and does not limit the present invention, and those of ordinary skill in the field to which the present invention pertains will understand that various combinations or modifications and applications that are not illustrated in the embodiments are possible without deviating from the essential technical contents of the present embodiments. Accordingly, technical details related to modifications and applications that can be easily derived from the embodiments of the present invention should be construed as being included in the present invention.

What is claimed is:

1. A cosmetic vessel comprising:

a vessel portion accommodating contents in a vessel body, an upper portion of the vessel portion being sealed by an upper cover portion, and the vessel portion comprising a discharge port at the upper portion of the vessel portion;

a pressurizing portion pressurizing an interior of the vessel body such that the contents are discharged; and an auxiliary portion configured to elevate and lower the pressurizing portion by rotation of the auxiliary portion, wherein the pressurizing portion performs a first upward movement toward the discharge port, and repeatedly performs a second upward movement and a downward movement during the first upward movement, such that a remaining pressure in the vessel body is removed.

2. The cosmetic vessel according claim 1, wherein the auxiliary portion comprises a plurality of pressurizing protrusions;

wherein the pressurizing portion comprises:

a head portion that is elevated and lowered in contact with an inner circumferential surface of the vessel body; and a pressurizing structure portion that is coupled to the auxiliary portion at a lower portion of the head portion and forming a pressurizing guideline, wherein the first upward movement is an upward movement of the pressurizing portion caused by the upward movement of the auxiliary portion toward the discharge port, and wherein the second upward movement is an upward movement of the pressurizing portion as the plurality of pressurizing protrusions rotate along the pressurizing guideline around a circumference of the pressurizing structure portion.

3. The cosmetic vessel according claim 1, wherein the pressurizing portion includes:

a head portion that is elevated and lowered in contact with an inner circumferential surface of the vessel body; and a pressurizing structure portion that is coupled to the auxiliary portion at a lower portion of the head portion and that causes the head portion to repeatedly undergo an upward movement and a downward movement alternately while the head portion is elevated and lowered.

4. The cosmetic vessel according claim 3, wherein the head portion is provided with a plurality of second guide protrusions on an outer circumferential surface, wherein the pressurizing structure portion includes:

a first annular member being connected to the head portion, having a diameter smaller than a diameter of the head portion, and having a lower surface forming a first wave shape;

a second annular member being connected to the first annular member and having a diameter smaller than the diameter of the first annular member; and a third annular member being connected to the second annular member, having a diameter equal to the diameter of the first annular member, and having an upper surface forming a second wave shape, and wherein the pressurizing structure portion forms a pressurizing guideline causing the head portion to undergo an upward movement and a downward movement alternately and repeatedly while the head portion is elevated and lowered by the first annular member, the second annular member, and the third annular member.

5. The cosmetic vessel according claim 4, wherein each of the first wave shape and the second wave shape is a sine wave shape of a same period with repeated trough portions and crest portions, and wherein a distance from a first trough portion and a crest portion is equal to a distance from the crest portion to a second trough portion or longer than the distance from the crest portion to the second trough portion or shorter than the distance from the crest portion to the second trough portion.

6. The cosmetic vessel according claim 5, wherein the auxiliary portion includes a plurality of pressurizing protrusions inserted into the pressurizing guideline, wherein the plurality of pressurizing protrusions, while rotating and rising in a state of being inserted into the pressurizing guideline and moving from the crest portion to the first trough portion of the first wave shape, cause the head portion to undergo an upward movement, and thereby increasing an internal pressure of the vessel body so that the contents are discharged through the discharge port, and wherein the plurality of pressurizing protrusions, while rotating and rising in the state of being inserted into the pressurizing guideline and moving from the first trough portion to the crest portion of the first wave shape, cause the head portion to undergo a downward movement, and thereby decreasing the internal pressure of the vessel body so that the contents are not discharged by a residual pressure.

7. The cosmetic vessel according claim 6, wherein the pressurizing portion increases an amount of downward momentum of the head portion as a height difference value between the crest portion and the first trough portion of the first wave shape increases, thereby increasing a dissipated amount of an internal residual pressure, and wherein the height difference value is any one of 0.25 millimeters (mm), 0.35 mm, and 0.45 mm.

8. The cosmetic vessel according claim 6, wherein, when the plurality of pressurizing protrusions rotate and rise in a state of being inserted into the pressurizing guideline and undergo a rotational operation in one cycle from the crest portion of the first wave shape to another neighboring crest portion, the pressurizing portion causes the contents to be discharged once.

9. The cosmetic vessel according claim 8, wherein the pressurizing portion shortens a period of one cycle, as a distance value or angle value (based on a circle) between the first trough portion of the first wave shape and the second trough portion or between the crest portion and the second crest portion is decreased, thereby increasing a number of times of discharge of the contents and decreasing an amount of discharge of the contents based on a rotation of 360 degrees, and wherein the angle value is any one of 9 degrees, 18 degrees, 22.5 degrees, 45 degrees, and 90 degrees based on one cycle.

10. The cosmetic vessel according claim 4, further comprising:

a lower cover portion sealing an open lower portion of the vessel body;

a middle portion providing a rotational force to the auxiliary portion;

a fixed plate fixed to the lower cover portion; and a shaft portion provided with a male threaded pillar supported by the fixed plate and extending to an the upper portion of the vessel body.

11. The cosmetic vessel according claim 10, wherein the lower cover portion provides a rotational force to the auxiliary portion, and the lower cover portion and the middle portion directly provide the rotational force to the auxiliary portion or indirectly provide the rotational force to the auxiliary portion through the vessel body.

12. The cosmetic vessel according claim 10, wherein the vessel portion further comprises:

a plurality of coupling protrusions provided on a part of an upper outer circumferential surface of the vessel body; and a plurality of guide grooves extending from a lower portion to an upper portion in a groove shape in a constant interval on an inner circumferential surface of the vessel body, wherein the middle portion includes a rotatable intermediate body provided in the form of a shell on an upper outer circumferential surface of the vessel body, and a plurality of coupling grooves coupled to the plurality of coupling protrusions on a part of an upper inner circumferential surface, and wherein the auxiliary portion includes a support plate on which a female threaded member screwed to the male threaded pillar of the shaft portion is provided at a center, and a plurality of first guide protrusions provided on an outer circumferential surface of the support plate and inserted into the plurality of guide grooves of the vessel body.

13. The cosmetic vessel according claim 12, wherein the vessel body rotates together when the middle portion rotates, thereby transmitting a rotational force of the middle portion to the auxiliary portion, wherein the shaft portion rotates together when the lower cover portion rotates, thereby transmitting a rotational force of the lower cover portion to the auxiliary portion, and wherein the auxiliary portion receives a rotational force from the vessel body or the shaft portion and rotates to elevate and lower the pressurizing portion along the male threaded pillar.

14. The cosmetic vessel according claim 13, wherein the vessel body includes a plurality of sound bars provided along an edge of the open lower portion and having elasticity, and wherein the lower cover portion includes a plurality of sound protrusions continuously provided along an inner surface and generates a sound by friction of the plurality of sound bars with the plurality of sound protrusions when the vessel body is rotated by the rotationa rotation of the middle portion.

15. The cosmetic vessel according claim 14, wherein the vessel portion is fastened to the upper cover portion by a fastening means, wherein the fastening means includes:

a fastening groove provided along an inner circumferential surface of the upper cover portion; and a fastening protrusion provided continuously or discontinuously along the outer circumferential surface of the vessel body and fastened to the fastening groove in a snap-on fastening manner without horizontal restraining, and wherein, when the lower cover portion rotates in a state where the upper cover portion is fastened to the vessel portion, the fastening means causes the lower cover portion to rotate idle with respect to the upper cover portion so that a rotational force of the lower cover portion is not transferred to the shaft portion, thereby preventing the contents from being discharged.

16. The cosmetic vessel according claim 14, wherein, each time the pressurizing portion undergoes one cycle of rotational operation from a first crest portion of the first wave shape provided in the first annular member through a trough portion to another neighboring crest portion, any one of the plurality of sound protrusions undergoes friction with a sound bar once, and wherein, a process where the pressurizing portion undergoes one cycle of rotational operation, the contents are discharged once while moving from the first crest portion to the trough portion (upward movement of the pressurizing portion) but are not discharged while moving from the trough portion to a second crest portion (downward movement of the pressurizing portion).

17. The cosmetic vessel according claim 16, wherein the plurality of sound protrusions are arranged in a constant interval on an inner circumferential surface of the lower cover portion in a number corresponding to a value obtained by dividing a sum of a number of times of upward movement of the pressurizing portion and a number of times of downward movement by 2.

18. The cosmetic vessel according claim 16, wherein an angle value of one cycle of the pressurizing portion corresponds to a value obtained by dividing 360 degrees by a multiple of 4, and wherein, in the plurality of sound protrusions, the angle value of one cycle of the pressurizing portion is an arrangement angle value at which the plurality of sound protrusions are arranged in a constant interval on an inner circumferential surface of the lower cover portion.

19. The cosmetic vessel according claim 16, wherein each of the plurality of sound protrusions is arranged to correspond to a trough portion of a first wave shape, which is a point where discharge of the contents is completed once, so that a number of times of discharge of the contents is confirmed.

20. The cosmetic vessel according claim 12, wherein the auxiliary portion consists of a first auxiliary portion and a second auxiliary portion provided between the shaft portion and the pressurizing portion, wherein the first auxiliary portion includes:

the support plate seated on the fixed plate of the shaft portion;

the plurality of first guide protrusions provided on the outer circumferential surface of the support plate and inserted into the plurality of guide grooves of the vessel body; and the female threaded member provided at the center of the support plate and screwed to the male threaded pillar of the shaft portion, and wherein the second auxiliary portion includes:

a rim accommodating the pressurizing structure portion and having a plurality of cut grooves formed in a constant interval to have elasticity;

a plurality of pressurizing protrusions provided on an inner surface of the rim and inserted into the pressurizing guideline;

a coupling pillar protruding upward from a center of the rim to be inserted into a coupling hole of the pressurizing structure portion and provided with a first insertion hole penetrating upward and downward to cause the male threaded pillar of the shaft portion to be inserted; and a fixing protrusion provided on an inner lower portion of the rim and fixed to a fixing groove of the pressurizing structure portion.

21. The cosmetic vessel according claim 10, wherein the shaft portion includes a plurality of inserting grooves provided in a constant interval on an outer circumferential surface of the fixing plate, and wherein the plurality of inserting grooves are coupled to a plurality of fixing bars provided inside the lower cover portion.

22. The cosmetic vessel according claim 1, wherein a surface on which the discharge port is provided has any one shape of convex, concave, and flat shapes, and is formed of at least one of metal, aluminum, zinc alloy, ceramic, and plastic, and wherein the discharge port is formed in any one shape of a circular shape and a wavy shape.

23. A cosmetic product comprising:
the cosmetic vessel according to claim 1; and
cosmetic contents accommodated in the cosmetic vessel.

* * * * *